US010214998B2

(12) United States Patent
Hussey et al.

(10) Patent No.: US 10,214,998 B2
(45) Date of Patent: Feb. 26, 2019

(54) SHEAR MECHANISM WITH PREFERENTIAL SHEAR ORIENTATION

(71) Applicant: Halliburton Energy Services, Inc., Houston, TX (US)

(72) Inventors: Michael B. Hussey, Beaumont (CA); David Joe Steele, Arlington, TX (US); Aihua Liang, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 289 days.

(21) Appl. No.: 14/768,510

(22) PCT Filed: Nov. 13, 2014

(86) PCT No.: PCT/US2014/065345

§ 371 (c)(1),
(2) Date: Aug. 18, 2015

(87) PCT Pub. No.: WO2016/076867

PCT Pub. Date: May 19, 2016

(65) Prior Publication Data

US 2016/0341009 A1 Nov. 24, 2016

(51) Int. Cl.

| | |
|---|---|
| ***E21B 7/06*** | (2006.01) |
| ***E21B 23/01*** | (2006.01) |
| ***E21B 29/06*** | (2006.01) |
| ***E21B 41/00*** | (2006.01) |

(52) U.S. Cl.
CPC ..... *E21B 41/00* (2013.01); *E21B 7/061* (2013.01); *E21B 23/01* (2013.01); *E21B 29/06* (2013.01)

(58) Field of Classification Search
CPC ..... E21B 7/061; E21B 23/01; E21B 29/06; E21B 41/00
See application file for complete search history.

(56) References Cited

U.S. PATENT DOCUMENTS

| | | | | |
|---|---|---|---|---|
| 2,928,302 | A | 3/1960 | Owen et al. | |
| 3,138,987 | A | 6/1964 | Wing | |
| 3,449,998 | A | 6/1969 | Wing | |
| 3,501,994 | A | 3/1970 | Biermann | |
| 4,068,555 | A | 1/1978 | Volkman | |
| 5,035,292 | A * | 7/1991 | Bailey | E21B 7/061 175/45 |

(Continued)

FOREIGN PATENT DOCUMENTS

| | | |
|---|---|---|
| EP | 0840033 A1 | 5/1998 |
| EP | 1953397 A1 | 8/2008 |

(Continued)

OTHER PUBLICATIONS

International Search Report and Written Opinion for PCT/US2014/065345 dated Jul. 22, 2015.

*Primary Examiner* — Matthew R Buck
(74) *Attorney, Agent, or Firm* — Scott Richardson; C. Tumey Law Group PLLC

(57) ABSTRACT

An example whipstock assembly includes a whipstock providing a ramped surface and a longitudinal groove defined in the ramped surface. A lead mill is coupled to the whipstock with a shear fastener that provides resilience against premature shearing under torsional loads between the lead mill and the whipstock, while providing susceptibility to shearing under a predetermined axial load.

16 Claims, 13 Drawing Sheets

(56) References Cited

U.S. PATENT DOCUMENTS

| | | | | |
|---|---|---|---|---|
| 5,461,852 | A | 10/1995 | Nagamatsu | |
| 5,806,596 | A * | 9/1998 | Hardy | E21B 7/061 166/117.6 |
| 5,826,651 | A * | 10/1998 | Lee | E21B 7/061 166/117.6 |
| 5,894,889 | A * | 4/1999 | Dewey | E21B 7/061 166/117.5 |
| 6,050,334 | A | 4/2000 | McGarian et al. | |
| 6,146,188 | A | 11/2000 | Snyder | |
| 6,464,002 | B1 | 10/2002 | Hart et al. | |
| 6,719,045 | B2 | 4/2004 | Hart et al. | |
| 6,764,404 | B1 | 7/2004 | Gullickson et al. | |
| 7,677,853 | B2 | 3/2010 | Donovan | |
| 8,469,096 | B2 * | 6/2013 | McGarian | E21B 7/061 166/117.5 |
| 8,601,663 | B2 | 12/2013 | Ngo et al. | |
| 2002/0096325 | A1 | 7/2002 | Sonnier | |
| 2010/0224372 | A1 * | 9/2010 | Stowe | E21B 23/04 166/377 |
| 2012/0222902 | A1 * | 9/2012 | Alsup | E21B 29/06 175/61 |
| 2012/0261193 | A1 * | 10/2012 | Swadi | E21B 7/061 175/61 |

FOREIGN PATENT DOCUMENTS

| | | | |
|---|---|---|---|
| GB | 2140523 | A | 11/1984 |
| WO | 11020144 | A1 | 2/2011 |

* cited by examiner

SHEAR MECHANISM WITH PREFERENTIAL SHEAR ORIENTATION

BACKGROUND

Hydrocarbons can be produced through relatively complex wellbores traversing a subterranean formation. Some wellbores can be a multilateral wellbore, which includes one or more lateral wellbores that extend from a parent or main wellbore. Multilateral wellbores typically include one or more windows or casing exits defined in the casing that lines the wellbore to allow corresponding lateral wellbores to be formed. More specifically, a casing exit for a multilateral wellbore can be formed by positioning a whipstock in a casing string at a desired location in the main wellbore. The whipstock deflects one or more mills laterally (or in an alternative orientation) relative to the casing string. The deflected mill(s) machines away and eventually penetrates part of the casing to form the casing exit. Drill bits can be subsequently inserted through the casing exit in order to cut the lateral or secondary wellbore.

Single-trip whipstock designs allow a well operator to run the whipstock and the mills downhole in a single run, which greatly reduces the time and expense of completing a multilateral wellbore. Some conventional single-trip whipstock designs anchor a lead mill to the whipstock using a combination of a shear bolt and a torque lug. The shear bolt is typically not designed to shear in torque. Rather, the shear bolt is designed to shear upon assuming a particular set down weight when a well operator desires to free the mills from the whipstock. Such a configuration, however, may render the shear bolt susceptible to premature shearing in torque, which can fatigue the shear bolt and cause it to shear prematurely, and thereby prematurely freeing the lead mill from whipstock.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to multilateral wells in the oil and gas industry and, more particularly, to improved torque supports for mill and whipstock assemblies used to drill multilateral wells.

The embodiments described herein provide exemplary whipstock assemblies that allow more torque to be transmitted from a lead mill to a whipstock without risking failure of a shear bolt used to couple the lead mill to the whipstock. As a result, the whipstock may be able to assume rotational as well as axial thrust loads without risking premature failure of the shear bolt and premature detachment of the lead mill within a wellbore.

In one embodiment, for example, an exemplary whipstock assembly may include a shear bolt (e.g., fastener, etc.) that joins a lead mill to a whipstock, where the shear bolt can provide one or more grooves at a preferred shear region. The shear region can lie in a plane that forms a nonzero angle with respect to the mill axis and/or an oblique angle relative to a central axis of the shear bolt.

In a second embodiment, an exemplary shear bolt can provide one or more grooves at a preferred shear region. The grooves can extend partially circumferentially about a main body on different radial sides of a central axis. The grooves can be aligned to provide controllable susceptibility to shear under forces along an axis of the lead mill, while maintaining greater resilience to shear induced by torque transmitted from the lead mill to the whipstock.

In a third embodiment, an exemplary shear bolt provides flanges along a preferred shear region. The flanges can be aligned to provide reinforcement for greater resilience to shear induced by torque transmitted from the lead mill to the whipstock, while maintaining a controllable susceptibility to shear under forces along an axis of the lead mill.

Figure 1:
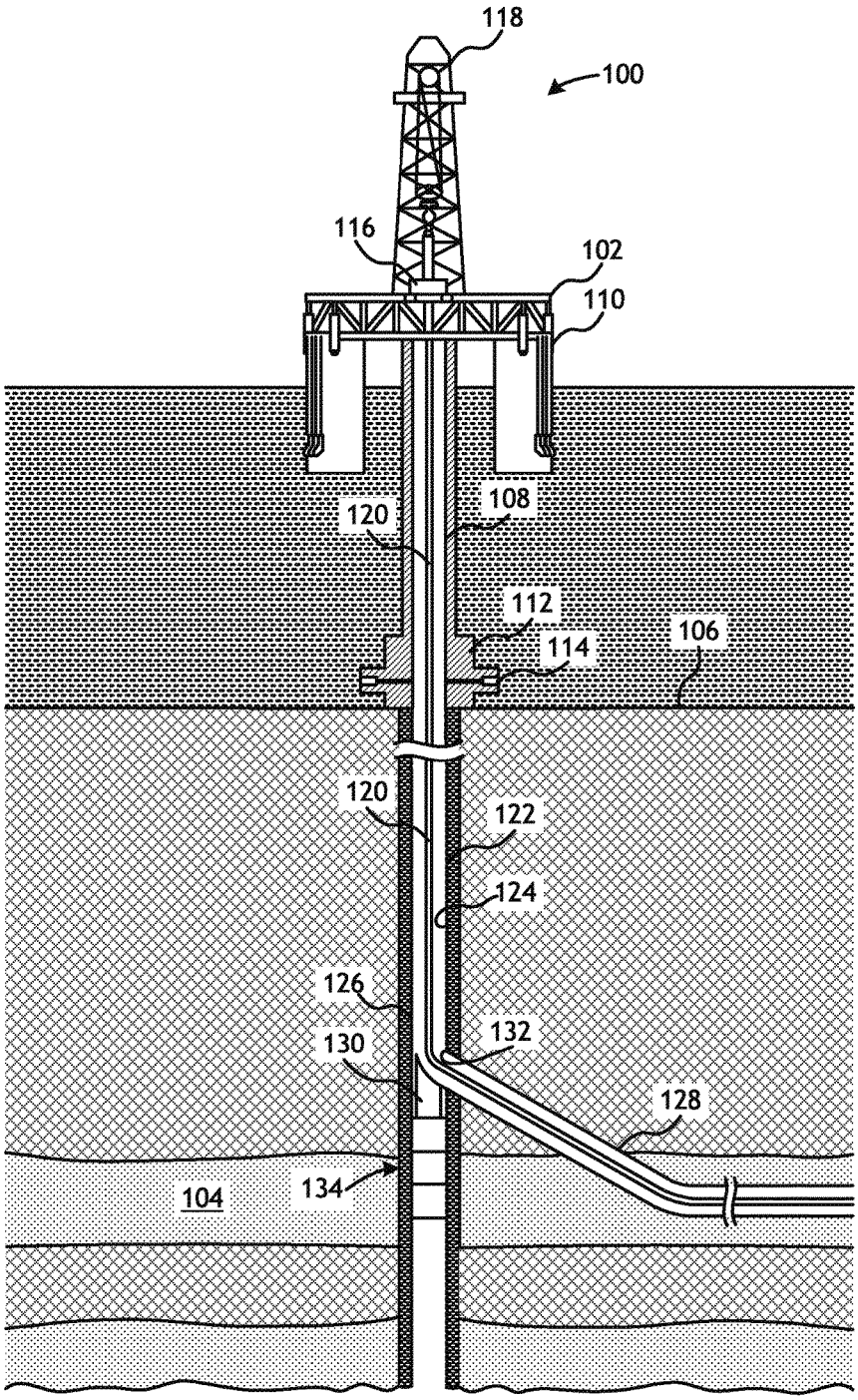
FIG. 1 shows a schematic diagram of a well system that may employ the principles of the present disclosure.

Referring to FIG. 1, illustrated is an exemplary well system 100 that may employ the principles of the present disclosure, according to one or more embodiments. As illustrated, the well system 100 may include an offshore oil and gas platform 102 centered over a submerged subterranean formation 104 located below the sea floor 106. While the well system 100 is described in conjunction with the offshore oil and gas platform 102, it will be appreciated that the embodiments described herein are equally well suited for use with other types of oil and gas rigs, such as land-based rigs or drilling rigs located at any other geographical site. The platform 102 may be a semi-submersible drilling rig, and a subsea conduit 108 may extend from the deck 110 of the platform 102 to a wellhead installation 112 that includes one or more blowout preventers 114. The platform 102 has a hoisting apparatus 116 and a derrick 118 for raising and lowering pipe strings, such as a drill string 120, within the subsea conduit 108.

As depicted, a main wellbore 122 has been drilled through the various earth strata, including the formation 104. The terms "parent" and "main" wellbore are used herein to designate a wellbore from which another wellbore is drilled. It is to be noted, however, that a parent or main wellbore is not required to extend directly to the earth's surface (or the wellhead installation 112), but could instead be a branch of another wellbore. A string of casing 124 is at least partially cemented within the main wellbore 122. The term "casing" is used herein to designate a tubular member or conduit used to line a wellbore. The casing 124 may actually be of the type known to those skilled in the art as "liner" and may be segmented or continuous, such as coiled tubing.

In some embodiments, a casing joint 126 may be interconnected between elongate upper and lower lengths or sections of the casing 124 and positioned at a desired location within the wellbore 122 where a branch or lateral wellbore 128 is to be drilled. The terms "branch" and "lateral" wellbore are used herein to designate a wellbore that is drilled outwardly from an intersection with another wellbore, such as a parent or main wellbore. Moreover, a branch or lateral wellbore may have another branch or lateral wellbore drilled outwardly therefrom at some point. A whipstock assembly 130 may be positioned within the casing 124 and secured and otherwise anchored therein at an anchor assembly 134 arranged or near the casing joint 126. The whipstock assembly 130 may operate to deflect one or more cutting tools (i.e., mills) into the inner wall of the casing joint 126 such that a casing exit 132 can be formed therethrough at a desired circumferential location. The casing exit 132 provides a "window" in the casing joint 126 through which one or more other cutting tools (i.e., drill bits) may be inserted to drill and otherwise form the lateral wellbore 128.

It will be appreciated by those skilled in the art that even though FIG. 1 depicts a vertical section of the main wellbore 122, the embodiments described in the present disclosure are equally applicable for use in wellbores having other directional configurations including horizontal wellbores, deviated wellbores, or slanted wellbores. Moreover, use of directional terms such as above, below, upper, lower, upward, downward, uphole, downhole, and the like are used in relation to the illustrative embodiments as they are depicted in the figures, the uphole direction being toward the surface of the well and the downhole direction being toward the toe of the well.

Figure 2A:
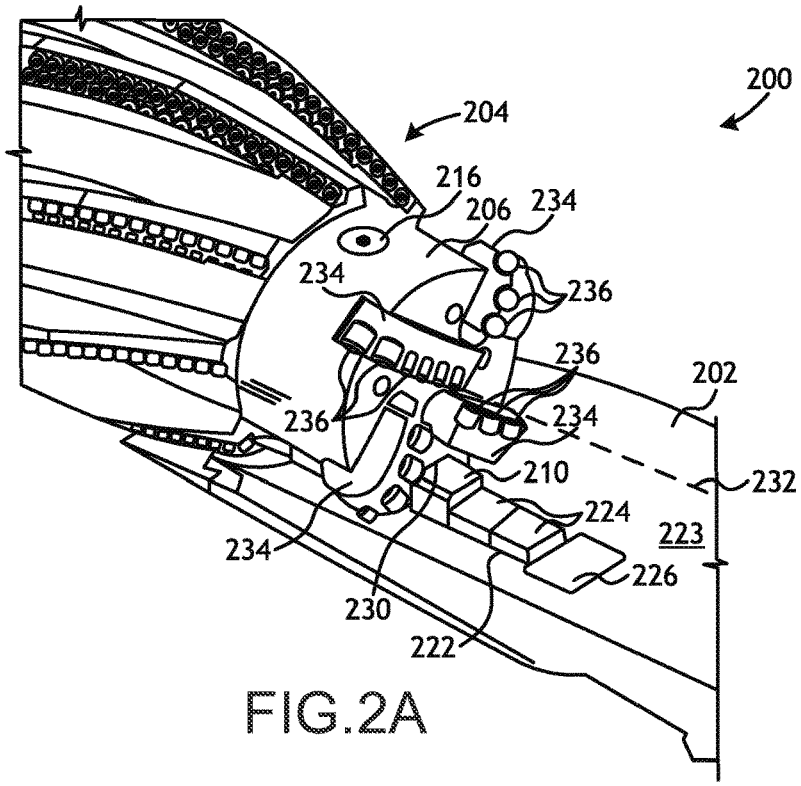
FIGS. 2A and 2B show isometric and cross-sectional side views, respectively, of an exemplary whipstock assembly.
Figure 2B:
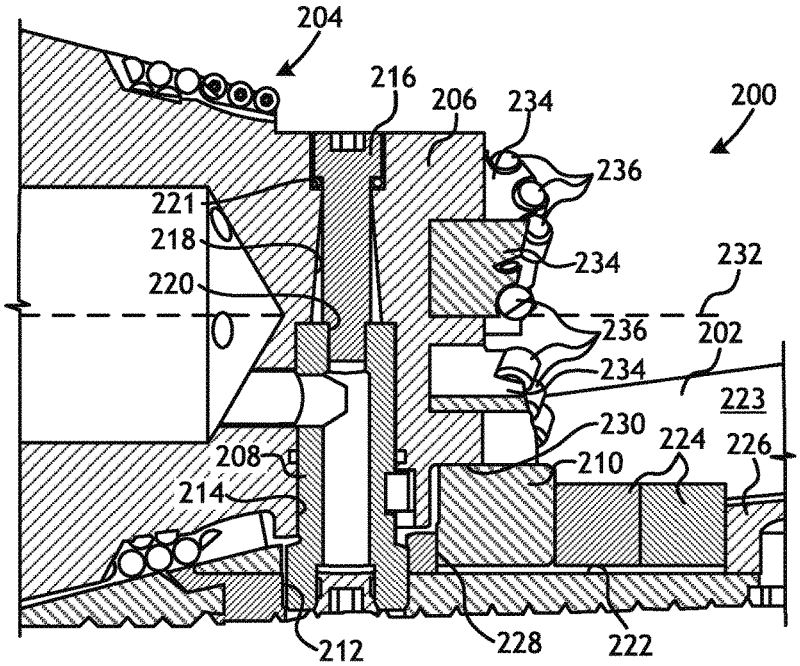

Referring now to FIGS. 2A and 2B, with continued reference to FIG. 1, illustrated is are views of an exemplary whipstock assembly 200. More particularly, FIG. 2A depicts an isometric view of the whipstock assembly 200, and FIG. 2B depicts a cross-sectional side view of the whipstock assembly 200. The whipstock assembly 200 may be similar to or the same as the whipstock assembly 130 of FIG. 1 and, therefore, may be able to be lowered into the wellbore 122 and secured therein to help facilitate the creation of the casing exit 132 in the casing 124.

As illustrated, the whipstock assembly 200 may include a deflector or whipstock 202 and one or more mills 204. The mills 204 may include a lead mill 206 configured to be coupled or otherwise secured to the whipstock 202. More particularly, the lead mill 206 may be secured to the whipstock 202 using at least a shear bolt 208 (FIG. 2B) and a torque lug 210. The shear bolt 208 may be configured to shear or otherwise fail upon assuming a predetermined axial load provided to the lead mill 206, and the torque lug 210 may provide the lead mill 206 with rotational torque resistance that helps prevent the shear bolt 208 from fatiguing prematurely in torque as the whipstock assembly 200 is run downhole. The features discussed herein with respect to the lead mill 206 can also apply to other types of mills, such as starter mills, pilot mills, taper mills, and/or multi-mills.

As best seen in FIG. 2B, in some embodiments, the shear bolt 208 may extend through and be threaded into a threaded aperture 212 defined through the underside of the whipstock 202. The shear bolt 208 may further extend into a shear bolt aperture 214 defined in the lead mill 206, where the threaded aperture 212 and the shear bolt aperture 214 are configured to axially align to cooperatively receive the shear bolt 208 therein. The shear bolt 208 may be secured within the lead mill 206 with a retaining bolt 216 that is extendable into a retaining bolt aperture 218 defined in the lead mill 206. As illustrated, the retaining bolt aperture 218 may be aligned with and otherwise form a contiguous portion of the shear bolt aperture 214. The retaining bolt 216 may be threadably secured to the shear bolt 208 at a threaded cavity 220 defined in the end of the shear bolt 208, and the head of the retaining bolt 216 may rest on a shoulder 221 defined in the retaining bolt aperture 218. With the shear bolt 208 threadably secured to the whipstock 202 and the retaining bolt 216 threadably secured to the shear bolt 208 at the threaded cavity 220, the lead mill 206 (and any other mills 204) may thereby be securely coupled to the whipstock 202.

The torque lug 210 may be a solid metal block made of, for example, aluminum or another easily millable material. The torque lug 210 may be arranged within a longitudinal groove 222 defined in a ramped surface 223 of the whipstock 202. The torque lug 210 may be arranged within the longitudinal groove 222 along with one or more bumper members 224 (two shown) and a whipstock plate 226. The bumper members 224 may be made of a pliable or flexible material, such as rubber or an elastomer, and the whipstock plate 226 may be configured to bias the bumper members 224 against the torque lug 210 so that the torque lug 210 is correspondingly urged against an axial end wall 228 of the longitudinal groove 222. The torque lug 210 may further be configured to be inserted or otherwise extended into a slot 230 defined in the lead mill 206. As arranged within the slot 230, the torque lug 210 may be configured to prevent the lead mill 206 (or the mills 204 generally) from rotating about a central axis 232.

In exemplary operation, and with continued reference to FIG. 1, the whipstock assembly 200 may be lowered downhole within the wellbore 122 with the mills 204 secured to the whipstock 202 as generally described above. Upon reaching a location in the wellbore 122 where the casing exit 132 is to be formed, the whipstock assembly 200 may be latched into the anchor assembly 134 (FIG. 1) previously arranged within the wellbore 122. Latching in the whipstock assembly 200 may include extending the whipstock assembly into the anchor assembly 134 and then rotating the whipstock assembly 200 as the whipstock assembly 200 is pulled back uphole or toward the surface. Once the whipstock assembly 200 is properly latched into the anchor assembly 134, weight is set down on the whipstock assembly 200 from a surface location. Placing weight on the whipstock assembly 200 may provide an axial load to the lead mill 206, which may transfer a predetermined axial load to the shear bolt 208. Upon assuming the predetermined axial load, the shear bolt 208 may shear or otherwise fail, and thereby free the mills 204 from axial engagement with the whipstock 202.

With the weight still applied on the lead mill 206, the torque lug 210 may be forced against the bumper members 224 in the downhole direction (i.e., to the right in FIG. 2B), and the bumper members 224 may provide an opposing biasing resistance to the torque lug 210 in the uphole direction (i.e., to the left in FIG. 2B). The mills 204 (including the lead mill 206) may then be pulled back in the uphole direction a short distance, and the bumper members 224 may then urge the torque lug 210 back against the axial end wall 228. Once free from the whipstock 202, the mills 204 may then be rotated about the central axis 232 and simultaneously advanced in the downhole direction. As the mills 204 advance downhole, they ride up the ramped surface 223 of the whipstock 202 until engaging and milling the inner wall of the casing 124 to form the casing exit 132.

As illustrated, the lead mill 206 may include one or more blades 234 (four shown) and a plurality of cutters 236 secured to each blade 234. In the above-described configuration, the lead mill 206 may pivot on the torque lug 210 upon assuming a torsional load. Such torsional loads may be generated while latching in the whipstock assembly 200, as described above, or while lowering the whipstock assembly 200 downhole through portions of the wellbore 122 (FIG. 1)

that require the whipstock assembly 200 to be rotated. Torsional loads applied to the whipstock assembly 200 may result in the lead mill 206 pivoting on the torque lug 210 and one of the blades 234 that contacts the ramped surface 223 of the whipstock 202. As a result, a lift force may be generated that places tensile and/or torsional loading on the shear bolt 208, which, if not properly mitigated, could fatigue the shear bolt 208 and otherwise causes it to fail prematurely.

Figure 3A:
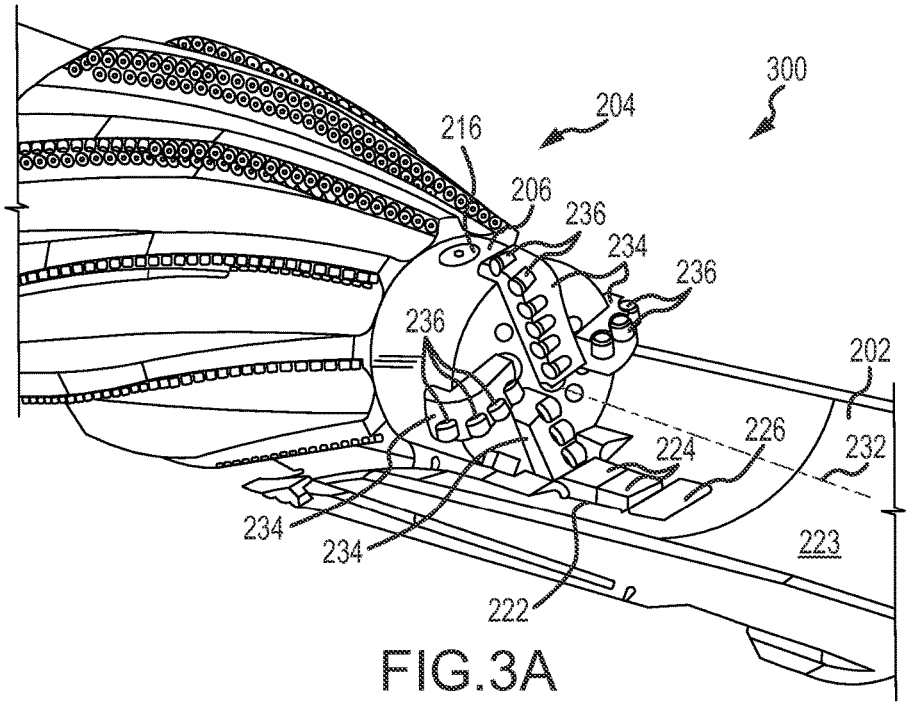
FIGS. 3A-3D show views of an exemplary whipstock assembly.
Figure 3B:
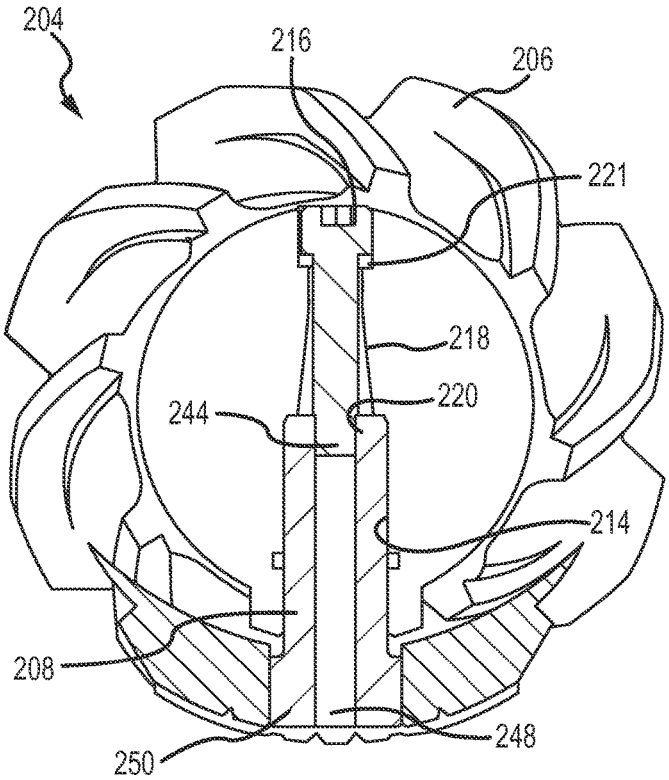
Figure 3C:
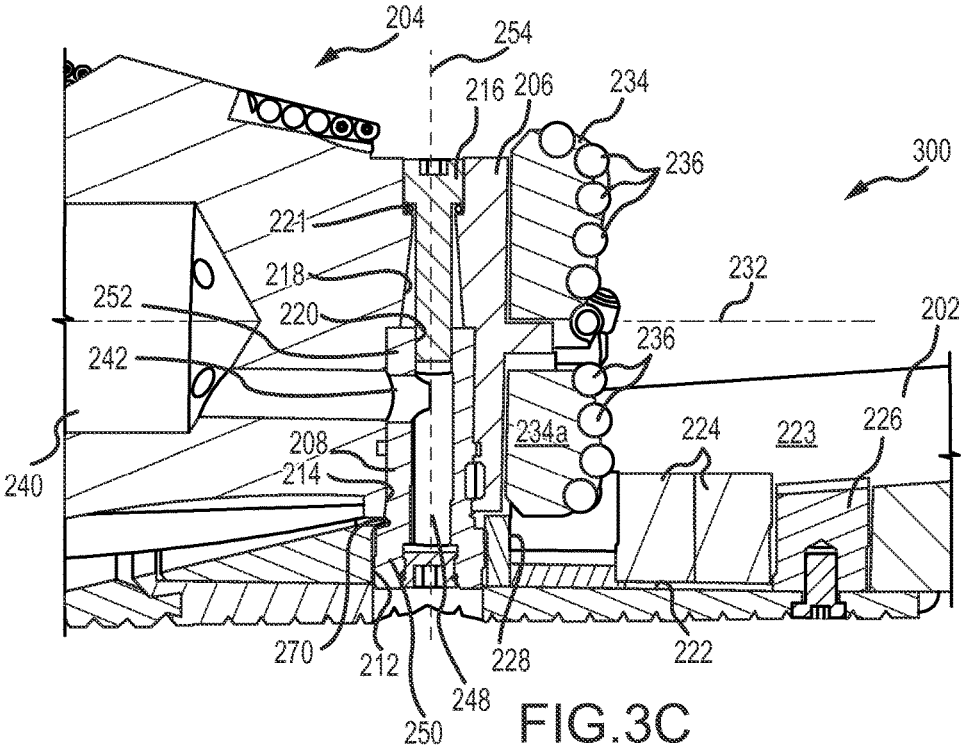
Figure 3D:
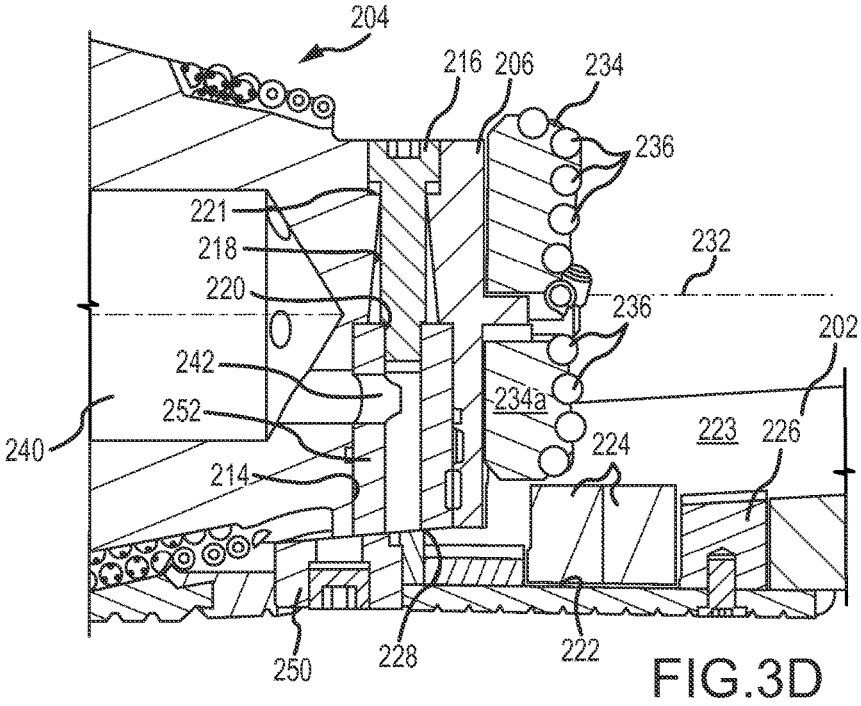

Referring now to FIGS. 3A-3D, with continued reference to FIGS. 2A-2B, illustrated are various views of an exemplary whipstock assembly 300, according to one or more embodiments of the present disclosure. More particularly, FIG. 3A depicts an isometric view of the whipstock assembly 300, FIG. 3B depicts a cross-sectional end view of the whipstock assembly 300, FIG. 3C depicts a cross-sectional side view of the whipstock assembly 300 in a joined configuration, and FIG. 3D depicts a cross-sectional side view of the whipstock assembly 300 in a sheared configuration. The whipstock assembly 300 may be similar in some respects to the whipstock assembly 200 of FIG. 2 and therefore may be best understood with reference thereto, where like numerals indicate like elements or components not described again in detail. Similar to the whipstock assembly 200 of FIG. 2, for example, the whipstock assembly 300 may include the whipstock 202, the mills 204 (including the lead mill 206), the shear bolt 208 used to secure the lead mill 206 to the whipstock 202, and the retaining bolt 216 used to secure the shear bolt 208 to the lead mill 206. Moreover, the lead mill 206 may include the blades 234 (four shown) and the plurality of cutters 236 secured to each blade 234, as generally described above. As will be appreciated, more or fewer than four blades 234 may be provided on the lead mill 206, without departing from the scope of the disclosure.

As best seen in FIGS. 3B and 3C, the shear bolt 208 may have an internal bolt channel 248 into which the retaining bolt 216 can engage the shear bolt 208 at the location of the threaded cavity 220. The internal bolt channel 248 of the shear bolt 208 can be provided in fluid communication with an internal mill channel 240 via a side port 242 of the shear bolt 208. The orientation of the shear bolt 208 that places the side port 242 of the shear bolt 208 in alignment with an opening to the internal mill channel 240 can correspond to a preferred orientation of the shear region with respect to the whipstock 202.

As shown in FIG. 3C, the shear bolt 208 can be oriented such that a central axis 254 of the shear bolt 208 is orthogonal to a central axis 232 of the mills 204 (including the lead mill 206). The retaining bolt 216 may be similarly oriented, such that a central axis of the retaining bolt 216 coincides with the central axis 254 of the shear bolt 208.

Figure 3E:
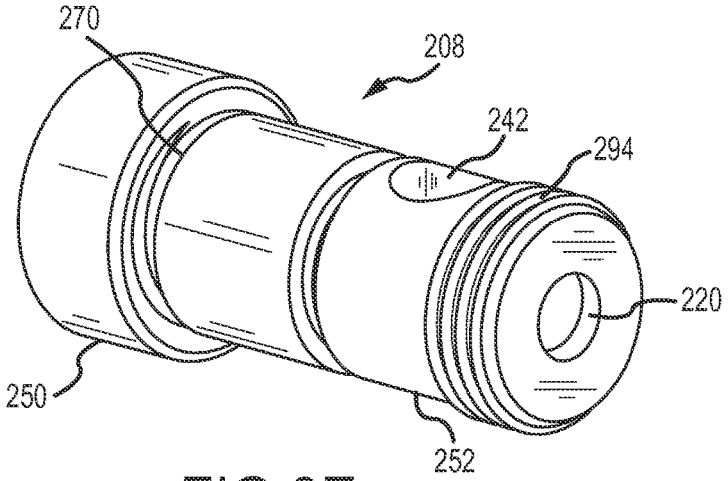
FIGS. 3E-3G show views of an exemplary shear bolt.
Figure 3F:
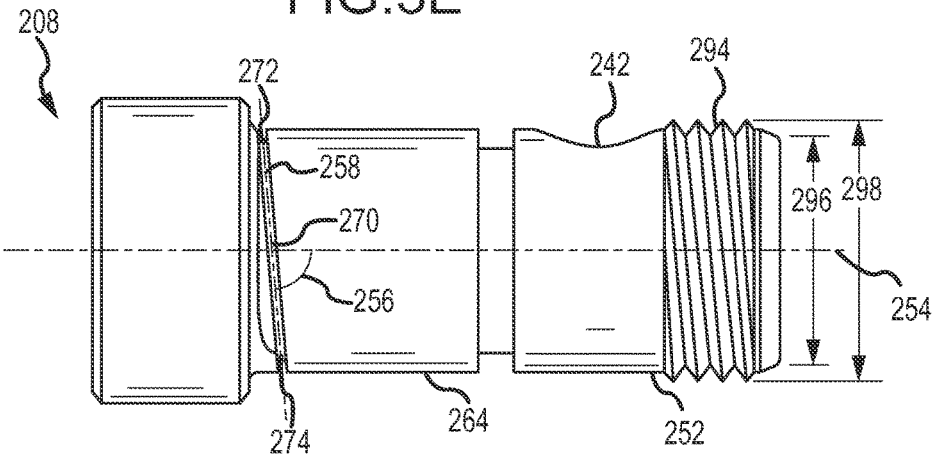
Figure 3G:
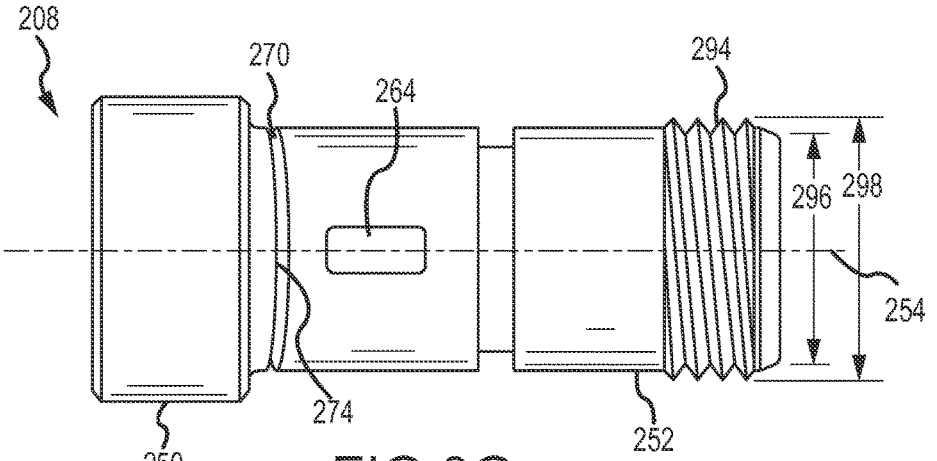

Referring now to FIGS. 3E-3G, with continued reference to FIGS. 3A-3D, illustrated are various views of an exemplary shear bolt 208, according to one or more embodiments of the present disclosure. More particularly, FIG. 3E depicts an isometric view of the shear bolt 208, and FIGS. 3F and 3G depict side views of the shear bolt 208. The shear bolt 208 may include a head 250 and a main body 252, separated by a shear region 270. The shear bolt 208 can further include an alignment guide 264 that can be aligned with a corresponding guide (e.g., pin) of the mills 204, wherein such an alignment corresponds to a desired orientation of the shear region 270.

As best seen in FIG. 3F, the shear region 270 may be formed as a groove with a radially inward intrusion from a radially outer periphery of the head 250 and/or the main body 252. The shear region 270 may lie in, contain, or otherwise be defined by a plane 258 extending entirely through the shear bolt 208. The plane 258 may form an angle 256 with respect to the central axis 254 of the shear bolt 208. The angle 256 may be the smallest one of several angles formed by a given intersection of the plane 258 and the central axis 254. The angle 256 may be perpendicular, or the angle 256 may be acute, such that the plane 258 is oblique with respect to the central axis 254. For example, the angle 256 may be greater than 60°, less than 90°, and/or equal to 90°.

As best seen in FIG. 3F, the shear region 270 can include a first shear section 272 and a second shear section 274. The first and second shear sections 272 and 274 can be positioned on radially opposite sides of the central axis 254 such that they are spaced or offset about the central axis 254 (i.e. circumferentially spaced) from each other by 180°. The axial locations of the first and second shear sections 272 and 274 can be different, to define the plane 258 as oblique with respect to the central axis 254. Accordingly, the first shear section 272 can be axially closer to an end of the shear bolts 208 formed by the head 250, and the second shear section 274 can be axially closer to an end of the shear bolt 208 formed by the main body 252. With brief reference again to FIG. 3D, the angle 256 may correspond to an angle of the ramped surface 223 of the whipstock 202 with respect to a central axis 232 of the mills 204. For example, the angle 256 may be complementary with respect to the angle of the ramped surface 223. Accordingly, such a configuration provides a shear region 270 that forms an angle similar to that of the ramped surface 223, to provide a smooth transition.

According to some embodiments, the shear bolt 208 can provide a threaded region 294 to facilitate engagement with other structures. The threaded region 294 is optionally provided on an exterior surface of the shear bolt 208 at a location apart from the shear region 270. The threaded region 294 can define a minor diameter 296 and a major diameter 298. According to some embodiments, the grooves 272, 274 can extend radially inwardly of the minor diameter 296.

With continued reference to FIGS. 3A-3G, and reference again to FIG. 1, exemplary operation of the whipstock assembly 300 with shear bolt 208 is now provided. The whipstock assembly 300 may be similar to or the same as the whipstock assembly 130 of FIG. 1 and, therefore, may be able to be lowered into the wellbore 122 and secured therein to help facilitate the creation of the casing exit 132 in the casing 124. Accordingly, the whipstock assembly 300 may be lowered downhole within the wellbore 122 with the mills 204 secured to the whipstock 202. Upon reaching a location in the wellbore 122 where the casing exit 132 is to be formed, the whipstock assembly 300 may be latched into the anchor assembly 134 previously arranged within the wellbore 122, as generally described above.

As the whipstock assembly 300 is conveyed downhole and subsequently latched into the anchor assembly 134, the blade 234*a* of the lead mill 206 may be extended into the slot 308 of the bearing support 306. Once the whipstock assembly 300 is properly latched into the anchor assembly 134, weight is set down on the whipstock assembly 300 from a surface location, which provides an axial load to the lead mill 206 and transfers a predetermined axial load to the shear bolt 208. Upon assuming the predetermined axial load, the shear bolt 208 may shear or otherwise fail, and thereby free the mills 204 from engagement with the whipstock 202.

As discussed herein, the angle 256 of the shear region 270 can align with an angle of the ramped surface 223 of the whipstock 202. Accordingly, the forces applied to the shear bolt 208 can be directed in a manner that tends to promote shearing within the shear region 270. The direction of this force can also correspond to the direction of travel of the mill 204 along the ramped surface 223 after shearing. For example, after shearing, the main body 252 of the shear bolt 208 transitions smoothly with the mill 204 along the ramped surface 223 of the whipstock 202. The remaining end of the main body 252 that was within the shear region 270 can better conform to and remain flush with the ramped surface 223 to reduce undesirable friction and interference as it travels along the ramped surface 223. As such, free motion of the mill 204 and the main body 252 after shearing is facilitated by the angle of the shear region 270.

According to the present disclosure, embodiments of improved whipstock assemblies may allow more torque to be transmitted from the lead mill 206 to the whipstock 202 without shearing or otherwise compromising the structural integrity of the shear bolt 208. As described herein, such improved whipstock assemblies may be configured to better endure such torsional forces, and thereby prevent the shear bolt 208 from fatigue or premature shearing in torque.

Figure 4A:
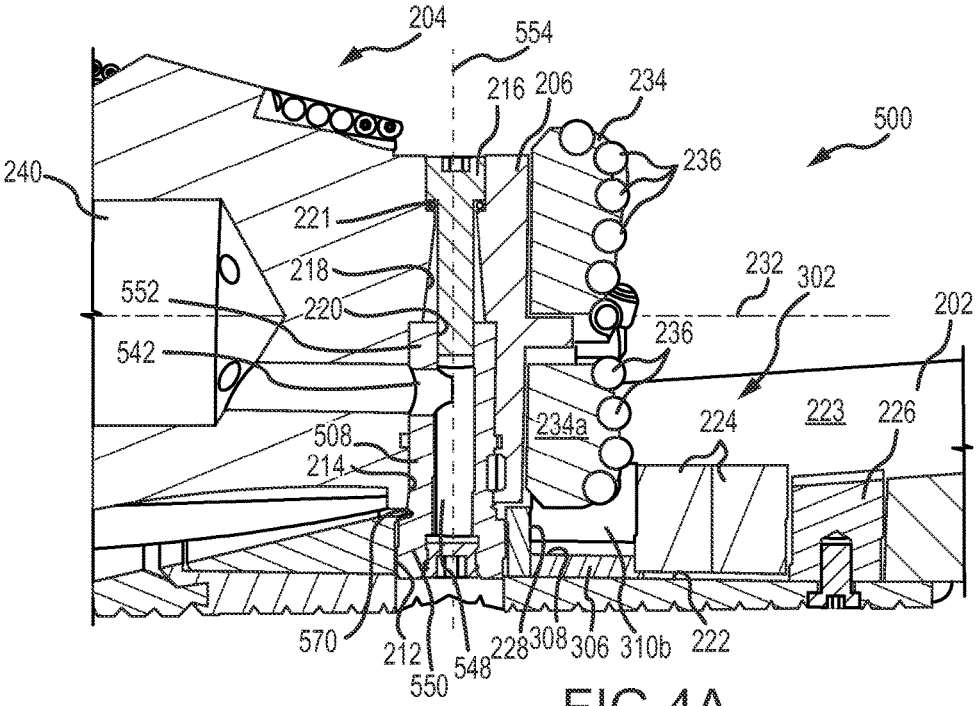
FIGS. 4A and 4B show views of an exemplary whipstock assembly
Figure 4B:
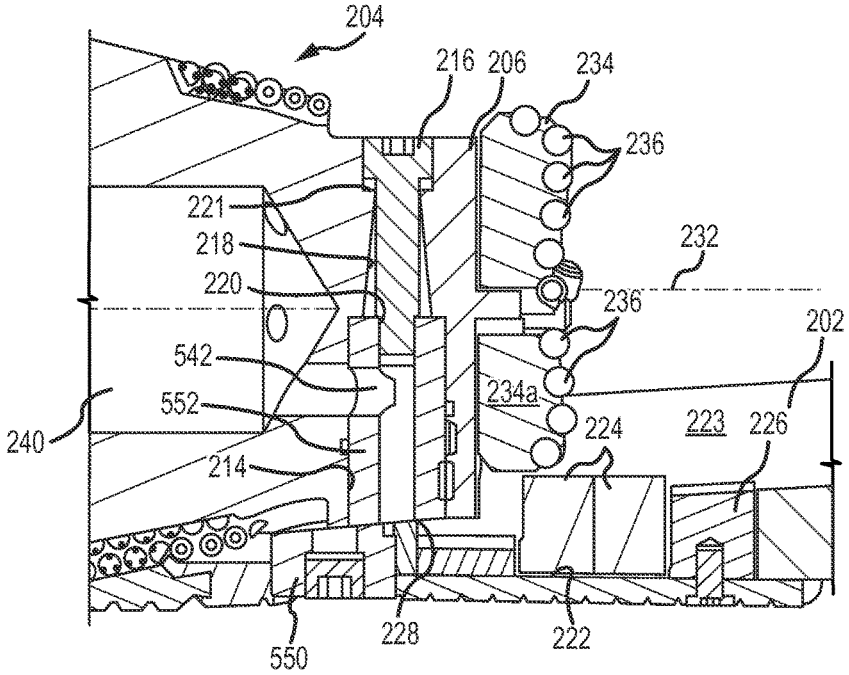

Referring now to FIGS. 4A and 4B, illustrated are various views of another exemplary whipstock assembly 500, according to one or more embodiments of the present disclosure. More particularly, FIG. 4A depicts a cross-sectional side view of the whipstock assembly 500 in a joined configuration, and FIG. 4B depicts a cross-sectional side view of the whipstock assembly 500 in a sheared configuration. The whipstock assembly 500 may be similar in some respects to the whipstock assembly 300 of FIG. 3A-3D and therefore may be best understood with reference thereto, where like numerals indicate like elements or components not described again in detail. Similar to the whipstock assembly 300 of FIG. 3A-3D, for example, the whipstock assembly 500 may include the whipstock 202 and the mills 204 (including the lead mill 206). The whipstock assembly 500 may further include a shear bolt 508 used to secure the lead mill 206 to the whipstock 202 and a retaining bolt 216 used to secure the shear bolt 508 to the lead mill 206. Moreover, the lead mill 206 may include the blades 234 (four shown) and the plurality of cutters 236 secured to each blade 234, as generally described above.

As best seen in FIGS. 4A and 4B, the shear bolt 508 may have an internal bolt channel 548 into which the retaining bolt 216 can engage the shear bolt 508 at the location of the threaded cavity 520. The internal bolt channel 548 of the shear bolt 508 can be provided in fluid communication with an internal mill channel 240 via a side port 542 of the shear bolt 508. The orientation of the shear bolt 508 that places the side port 542 of the shear bolt 508 in alignment with an opening to the internal mill channel 240 can correspond to a preferred orientation of the shear region with respect to the whipstock 202.

As shown in FIGS. 4A and 4B, the shear bolt 508 can be oriented such that a central axis 554 (FIG. 4A) of the shear bolt 508 is orthogonal to a central axis 232 of the mills 204 (including the lead mill 206). The retaining bolt 216 may be similarly oriented, such that a central axis of the retaining bolt 216 coincides with the central axis 554 of the shear bolt 508.

Figure 4C:
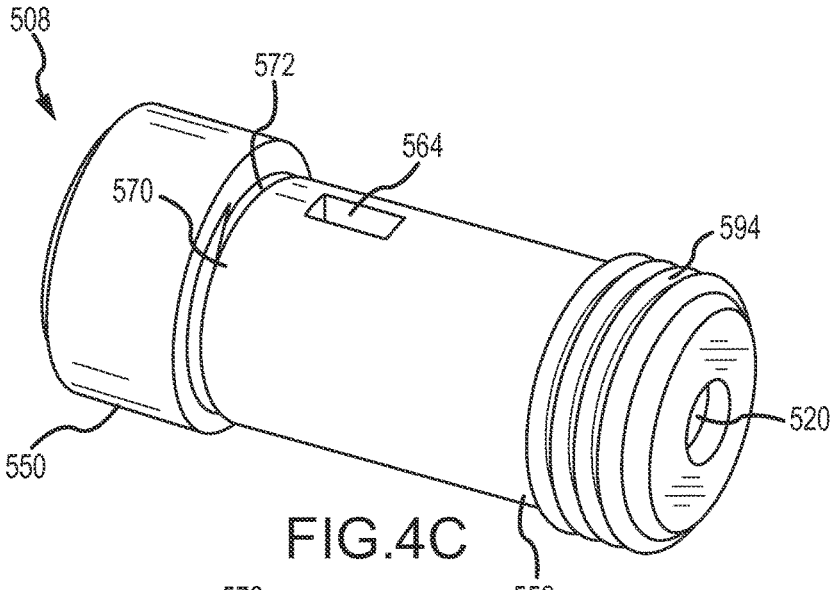
FIGS. 4C-4E show views of an exemplary shear bolt.
Figure 4D:
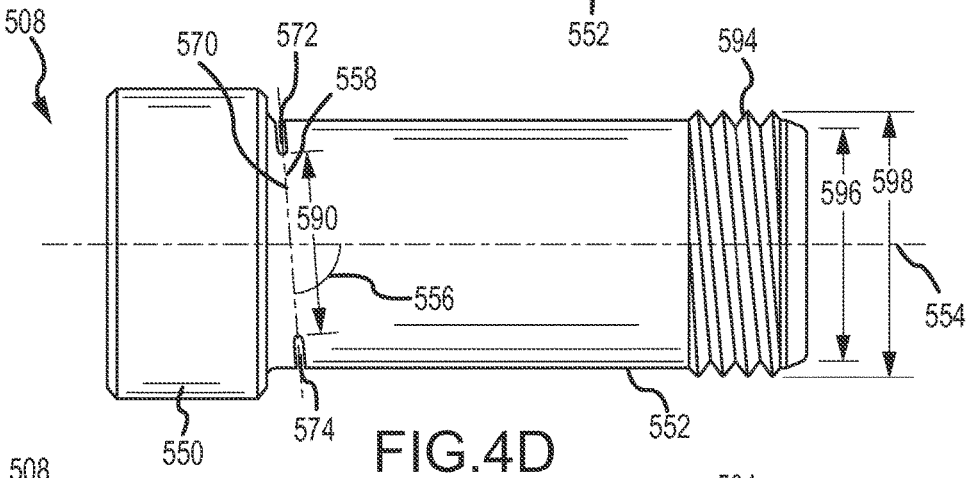
Figure 4E:
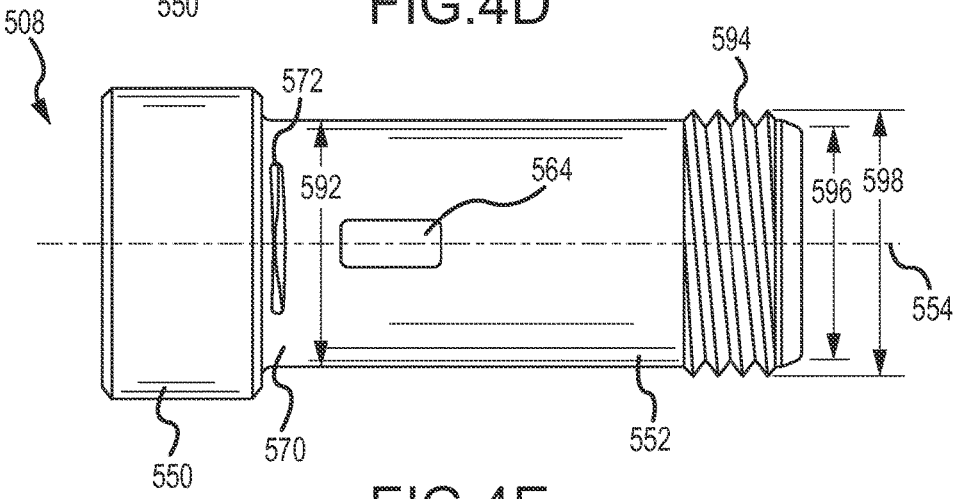

Referring now to FIGS. 4C-4E, with continued reference to FIGS. 4A-4B, illustrated are various views of an exemplary shear bolt 508, according to one or more embodiments of the present disclosure. More particularly, FIG. 4C depicts an isometric view of the shear bolt 508, and FIGS. 4D and 4E depict side views of the shear bolt 508. The shear bolt 508 of FIGS. 4C-4E may be, in some respects, similar to the shear bolt 208 of FIGS. 3E-3G. For example, the shear bolt 508 may include a head 550 and a main body 552, separated by a shear region 570. Moreover, the shear bolt 508 may include a threaded cavity 520 and a side port 542 (FIGS. 4A-4B). The shear bolt 508 can further include an alignment guide 564 that can be aligned with a corresponding guide (e.g., pin) of the mills 204, wherein such an alignment corresponds to a desired angular orientation of the shear region 570.

As best seen in FIG. 4D, the shear region 570 may be formed as one or more grooves. For example, the shear region 570 can include a first groove 572 and a second groove 574. Each of the grooves 572, 574 can be formed by a radially inward intrusion from a radially outer periphery of the head 550 and/or the main body 552. Each of the grooves 572, 574 of the shear region 570 may extend only partially circumferentially about the central axis 554, such that the grooves are circumferentially spaced about the central axis and the grooves do not connect with one another. The circumferentially spaced grooves 572 and 574 result in a shear region 570 of the main body 552 that has a greater width 592 (see FIG. 4E) in a first dimension orthogonal to the central axis 554, i.e., from the first groove 572 to the second groove 574, and within a plane 558 of the shear region 570. The grooves 572 and 574 may further produce the shear region 570 such that the shear region 570 has a lesser width 590 (see FIG. 4D), smaller than the greater width 592, in a second dimension transverse to the central axis 554 and within the plane 558. A trough of the groove 572 and/or the groove 574 can be flat, concave, convex, and/or undulating. The cross-section along the plane 558 can define a non-circular shape.

According to some embodiments, the shear bolt 508 can provide a threaded region 594 to facilitate engagement with other structures. The threaded region 594 is optionally provided on an exterior surface of the shear bolt 508 at a location apart from the shear region 570. The threaded region 594 can define a minor diameter 596 and a major diameter 598. According to some embodiments, the grooves 572, 574 can extend radially inwardly of the minor diameter 596, such that the lesser width 590 is smaller than the minor diameter 596. The greater width 592 can be larger or smaller than the minor diameter 596 and/or the major diameter 598, as desired.

The shear region 570 may lie in, contain, or otherwise be defined by the plane 558 extending entirely through the shear bolt 508. The plane 558 may form an angle 556 with respect to the central axis 554 of the shear bolt 508. The angle 556 may be the smallest one of several angles formed by a given intersection of the plane 558 and the central axis 554. The angle 556 may be perpendicular, or the angle 556 may be acute, such that the plane 558 is oblique with respect to the central axis 554. For example, the angle 556 may be greater than 60°, less than 90°, and/or equal to 90°.

As best seen in FIG. 4D, the first and second grooves 572 and 574 can be positioned on radially opposite sides of the central axis 554 such that they are spaced or offset about the central axis 554 (i.e. circumferentially spaced) from each other by 180°. The axial locations of the first and second grooves 572 and 574 can be different such that the plane 558 is oblique with respect to the central axis 554. Accordingly, the first groove 572 can be axially closer to an end of the shear bolt 508 formed by the head 550, and the second groove 574 can be axially closer to an end of the shear bolt 508 formed by the main body 552. With brief reference again to FIG. 4B, the angle 556 may correspond to an angle of the ramped surface 223 of the whipstock 202 with respect to a central axis 232 of the mills 204. For example, the angle 556 may be complementary with respect to an angle of the ramped surface 223. Such a configuration provides a shear region 570 that forms an angle similar to that of the ramped surface 223, to provide a smooth transition.

With continued reference to FIGS. 4A-4E, and reference again to FIG. 1, exemplary operation of the whipstock assembly 500 with shear bolt 508 is now provided. The whipstock assembly 500 may be similar to or the same as the whipstock assembly 130 of FIG. 1 and, therefore, may be able to be lowered into the wellbore 122 and secured therein to help facilitate the creation of the casing exit 132 in the casing 124. Accordingly, the whipstock assembly 500 may be lowered downhole within the wellbore 122 with the mills 204 secured to the whipstock 202, and upon reaching a location in the wellbore 122 where the casing exit 132 is to be formed, the whipstock assembly 500 may be latched into the anchor assembly 134, as generally described above.

As illustrated, the lead mill 206 may include one or more blades 234 (four shown) and a plurality of cutters 236 secured to each blade 234. In the above-described configuration, the lead mill 206 may pivot upon assuming a torsional load. Such torsional loads may be generated while latching in the whipstock assembly 200, as described above, or while lowering the whipstock assembly 500 downhole through portions of the wellbore 122 (FIG. 1) that require the whipstock assembly 500 to be rotated. Torsional loads applied to the whipstock assembly 500 may result in the lead mill 206 pivoting on one of the blades 234 that contacts the ramped surface 223 of the whipstock 202. A wider cross-sectional dimension of the shear region 570 can be aligned to sustain such torsional loads.

As the whipstock assembly 500 with shear bolt 508 is conveyed downhole and subsequently latched into the anchor assembly 134, the blade 234*a* of the lead mill 206 may be extended into the slot 308 of the bearing support 306. Once the whipstock assembly 500 is properly latched into the anchor assembly 134, weight is set down on the whipstock assembly 500 from a surface location, which provides an axial load to the lead mill 206 and transfers a predetermined axial load to the shear bolt 508. Upon assuming the predetermined axial load, the shear bolt 508 may shear or otherwise fail, and thereby free the mills 204 from engagement with the whipstock 202.

A narrower cross-sectional dimension of the shear region 570 (e.g., across grooves 572 and 574) can be angularly aligned such that it is subjected to the axial load. Accordingly, the shear region 570 of the shear bolt 508 allows more torque to be transmitted from the lead mill 206 to the whipstock 202 without shearing or otherwise compromising the structural integrity of the shear bolt 508, while also maintaining a susceptibility to shearing under predetermined axial loads.

Once free from the whipstock 202, the mills 204 may then be rotated about the central axis 232 and simultaneously advanced in the downhole direction (i.e., to the right in FIGS. 4A and 4B). As the mills 204 advance downhole, they ride up the ramped surface 223 of the whipstock 202 until engaging and milling the inner wall of the casing 124 to form the casing exit 132.

Figure 5A:
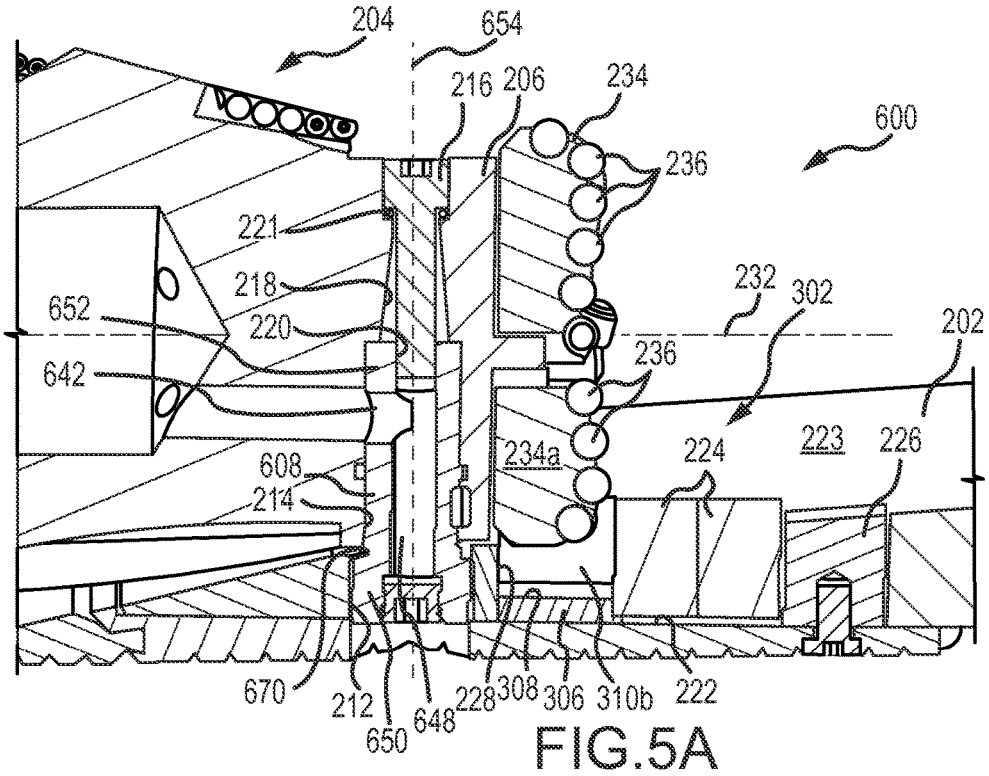
FIGS. 5A and 5B show views of an exemplary whipstock assembly
Figure 5B:
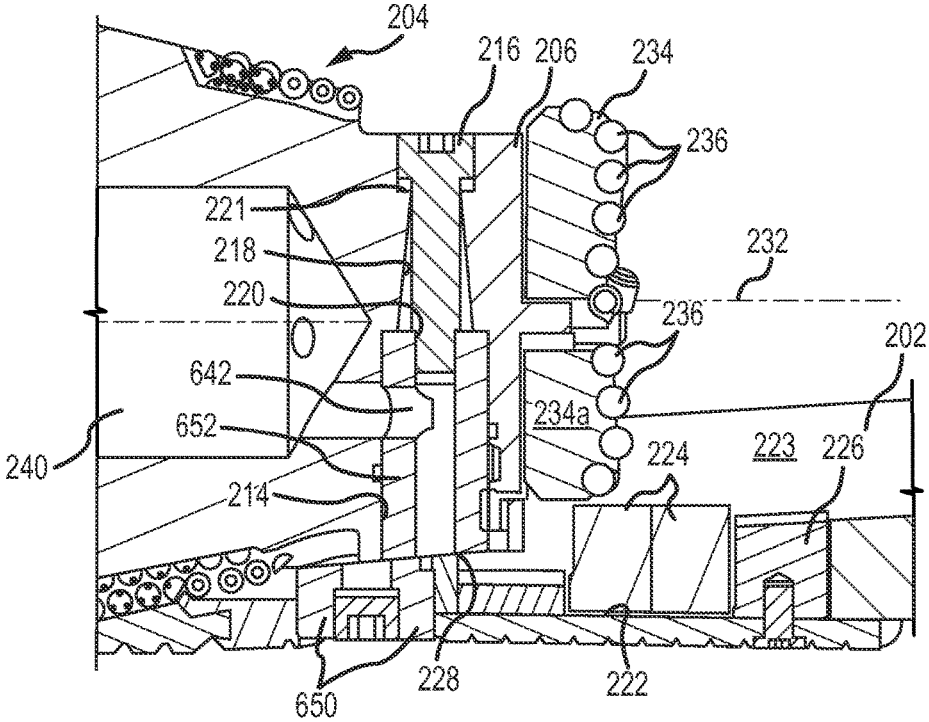

Referring now to FIGS. 5A and 5B, illustrated are various views of an exemplary whipstock assembly 600, according to one or more embodiments of the present disclosure. More particularly, FIG. 5A depicts a cross-sectional side view of the whipstock assembly 600 in a joined configuration, and FIG. 5B depicts a cross-sectional side view of the whipstock assembly 600 in a sheared configuration. The whipstock assembly 600 may be similar in some respects to the whipstock assembly 300 of FIG. 3A-3D and therefore may be best understood with reference thereto, where like numerals indicate like elements or components not described again in detail. Similar to the whipstock assembly 300 of FIG. 3A-3D, for example, the whipstock assembly 600 may include the whipstock 202 and the mills 204 (including the lead mill 206). The whipstock assembly 600 may further include a shear bolt 608 used to secure the lead mill 206 to the whipstock 202 and a retaining bolt 216 used to secure the shear bolt 608 to the lead mill 206. Moreover, the lead mill 206 may include the blades 234 (four shown) and the plurality of cutters 236 secured to each blade 234, as generally described above.

As best seen in FIGS. 5A and 5B, the shear bolt 608 may have an internal bolt channel 648 into which the retaining bolt 216 can engage the shear bolt 608 at the location of the threaded cavity 620. The internal bolt channel 648 of the shear bolt 608 can be provided in fluid communication with an internal mill channel 240 via a side port 642 of the shear bolt 608. The orientation of the shear bolt 608 that places the side port 642 of the shear bolt 608 in alignment with an opening to the internal mill channel 240 can correspond to a preferred orientation of the shear region with respect to the whipstock 202.

As shown in FIGS. 5A and 5B, the shear bolt 608 can be oriented such that a central axis 654 (FIG. 6A) of the shear bolt 608 is orthogonal to a central axis 232 of the mills 204 (including the lead mill 206). The retaining bolt 216 may be similarly oriented, such that a central axis of the retaining bolt 216 coincides with the central axis 654 of the shear bolt 608.

Figure 5C:
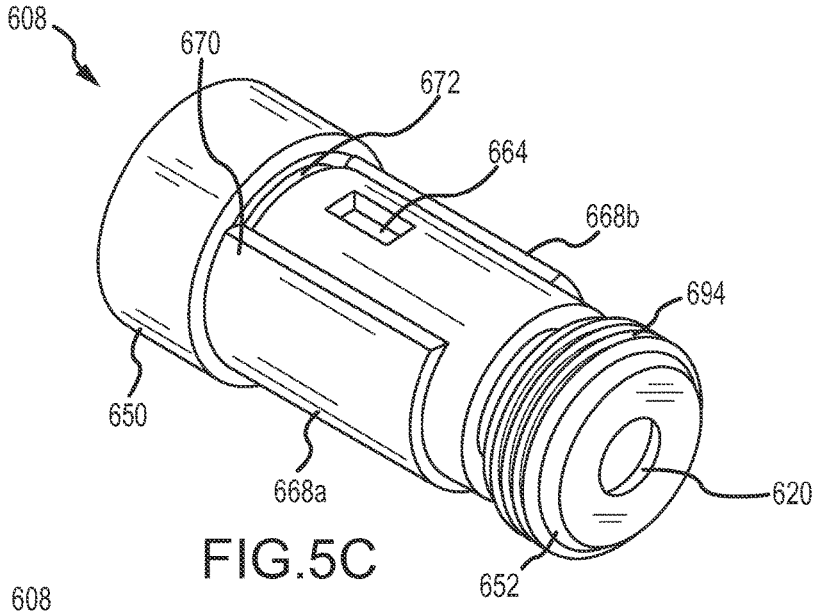
FIGS. 5C-5G show views of an exemplary shear bolt.
Figure 5D:
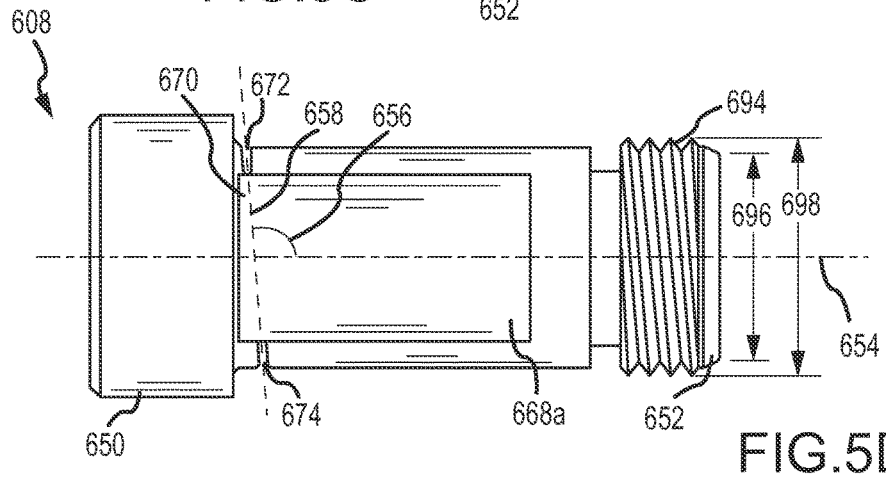
Figure 5E:
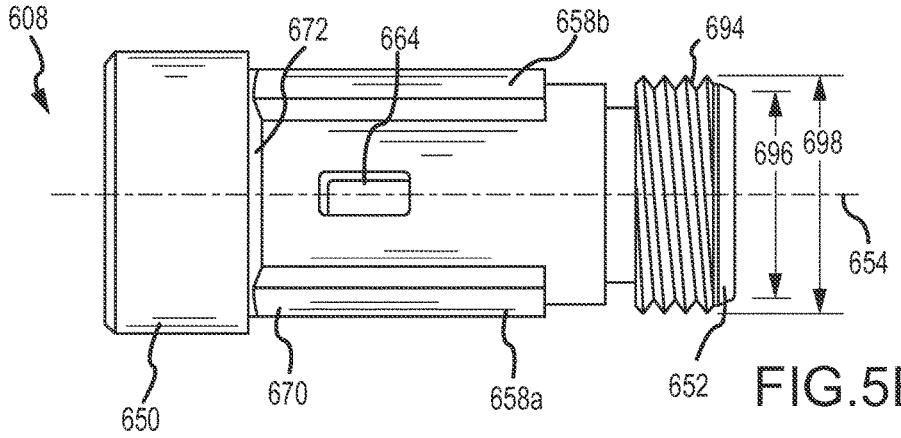

Referring now to FIGS. 5C-5E, with continued reference to FIGS. 5A-5B, illustrated are various views of an exemplary shear bolt 608, according to one or more embodiments of the present disclosure. More particularly, FIG. 5C depicts an isometric view of the shear bolt 608, and FIGS. 5D and 5E depict side views of the shear bolt 608. The shear bolt 608 of FIGS. 5C-5E may be, in some respects, similar to the shear bolt 508 of FIGS. 4C-4E. For example, the shear bolt 608 may include a head 650 and a main body 652, separated by a shear region 670. Moreover, the shear bolt 608 may include a threaded cavity 620 and a side port 642 (FIGS. 5A and 5B). The shear bolt 608 can further include an alignment guide 664 that can be angularly aligned with a corresponding guide (e.g., pin) of the mills 204, wherein such an angular alignment corresponds to a desired angular orientation of the shear region 670.

As best seen in FIG. 5D, the shear region 670 may be formed as one or more grooves. For example, the shear region 670 can include a first groove 672 and a second groove 674. Each of the grooves 672, 674 can be formed by a radially inward intrusion from a radially outer periphery of the head 650 and/or the main body 652. Each of the grooves 672, 674 of the shear region 670 may extend only partially circumferentially about the central axis 654, the grooves are circumferentially spaced about the central axis and the grooves do not connect with one another. The circumferentially spaced first and second grooves 672 and 674 can be positioned on radially opposite sides of the central axis 654 such that they are spaced or offset about the central axis 654 (i.e. circumferentially spaced) from each other by 180°. A trough of the groove 672 and/or the groove 674 can be flat, concave, convex, and/or undulating.

The shear bolt 608 may further include one or more flanges (e.g., a first flange 668*a* and a second flange 668*b*).

By further example, the shear bolt 608 may include only one or a plurality of flanges. Each of the flanges 668*a,b* can be formed by a radially outward protrusion from a radially outer periphery of the head 650 and/or the main body 652. The flanges 668*a,b* can be integrally formed (i.e., monolithic) with the head 650 and/or the main body 652. Each of the flanges 668*a,b* of the shear bolt 608 may extend only partially circumferentially about the central axis 654, such that the flanges 668*a,b* do not connect with one another. The first and second flanges 668*a,b* can be positioned on radially opposite sides of the central axis 654. The first and second flanges 668*a,b* can extend axially from the head 650 along a portion of the length of the main body 652, such that the first and second flanges 668*a,b* span at least the shear region 670. The lead mill 206 can be formed to accommodate the shear bolt 608, including the flanges 668*a,b*. For example, the shear bolt 608 can be received into the lead mill 206 in a particular orientation that corresponds to a desired angular orientation of the shear region 670.

Figure 5F:
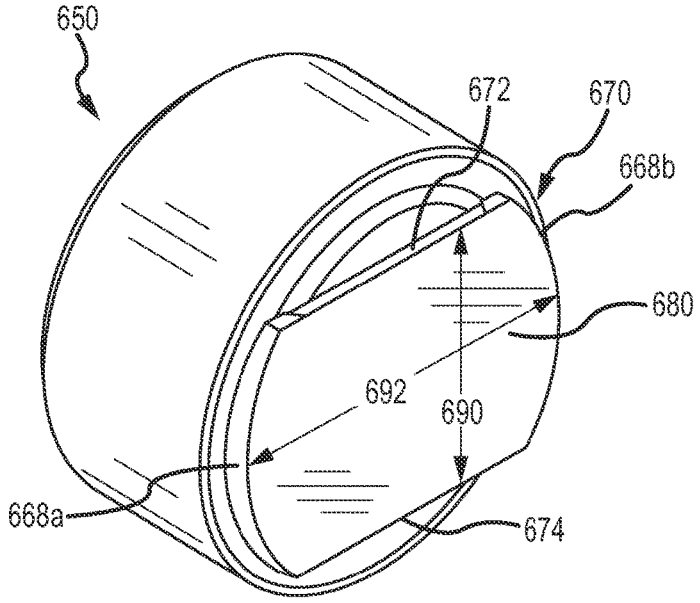
Figure 5G:
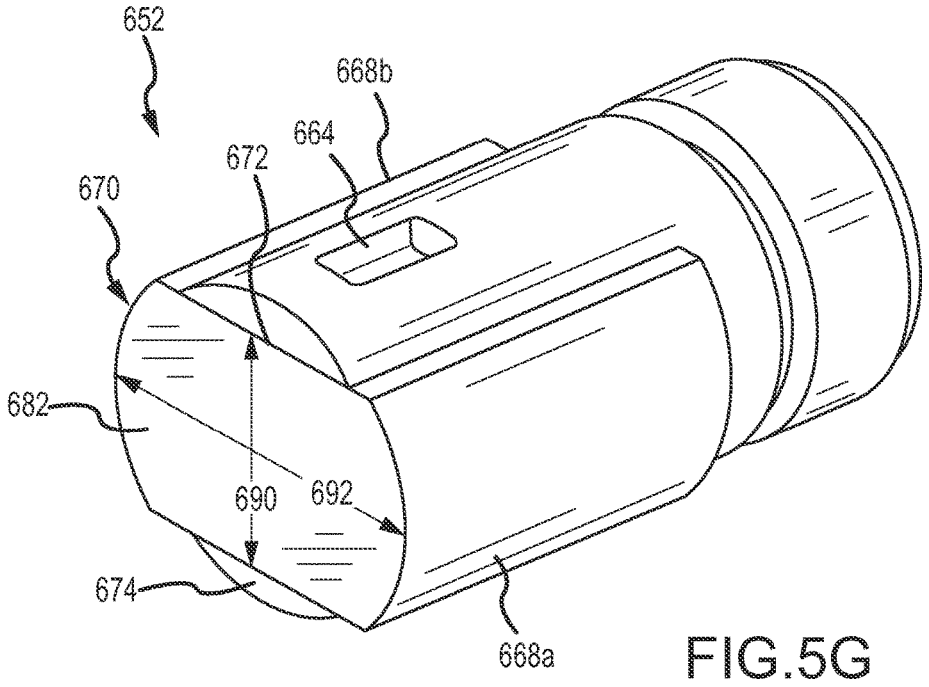

As best seen in FIGS. 5F and 5G, the grooves 672 and 674 and the flanges 668*a,b* result in a shear region 670 that has a greater width 692 in a first dimension orthogonal to the central axis 654, i.e., from the first groove 672 to the second groove 674 and within a plane 658 of the shear region 670. The circumferentially spaced grooves 672 and 674 may further produce the shear region 670 such that the shear region 670 has a lesser width 690, smaller than the greater width 692, in a second dimension transverse to the central axis 654 and within the plane 658. The lesser width 690 can be the shortest distance across the shear region 670. The lesser width 690 can be generally aligned with the axial force intended to shear the shear bolt 608, thereby defining an axial shear limit. The greater width 692 can be the longest distance across the shear region 670. The greater width 692 can be generally aligned to sustain a torsional load applied to the whipstock assembly 600, thereby defining a rotary shear limit, greater than the axial shear limit. The cross-section along the plane 658 can define a non-circular shape.

According to some embodiments, the shear bolt 608 can provide a threaded region 694 to facilitate engagement with other structures. The threaded region 694 is optionally provided on an exterior surface of the shear bolt 608 at a location apart from the shear region 670. The threaded region 694 can define a minor diameter 696 and a major diameter 698. According to some embodiments, the grooves 672, 674 can extend radially inwardly of the minor diameter 696, such that the lesser width 690 is smaller than the minor diameter 696. The greater width 692 can be larger or smaller than the minor diameter 696 and/or the major diameter 698, as desired.

Referring again to FIG. 5D, the shear region 670 may lie in, contain, or otherwise be defined by the plane 658 extending entirely through the shear bolt 608. The plane 658 may form an angle 656 with respect to the central axis 654 of the shear bolt 608. The angle 656 may be the smallest one of several angles formed by a given intersection of the plane 658 and the central axis 654. The angle 656 may be perpendicular, or the angle 656 may be acute, such that the plane 658 is oblique with respect to the central axis 654. For example, the angle 656 may be greater than 60°, less than 90°, and/or equal to 90°. The first and second grooves 672 and 674 can be positioned on radially opposite sides of the central axis 654. The axial locations of the first and second grooves 672 and 674 can be different, to define a plane 658 that is oblique with respect to the central axis 654. Accordingly, the first groove 672 can be axially closer to an end of the shear bolts 608 formed by the head 650, and the second groove 674 can be axially closer to an end of the shear bolt 608 formed by the main body 652. With brief reference again to FIG. 5B, the angle 656 may correspond to an angle of the ramped surface 223 of the whipstock 202 with respect to a central axis 232 of the mills 204. For example, the angle 656 may be complementary with respect to an angle of the ramped surface 223. Such a configuration provides a shear region 670 that forms an angle similar to that of the ramped surface 223, to provide a smooth transition.

Figure 6:
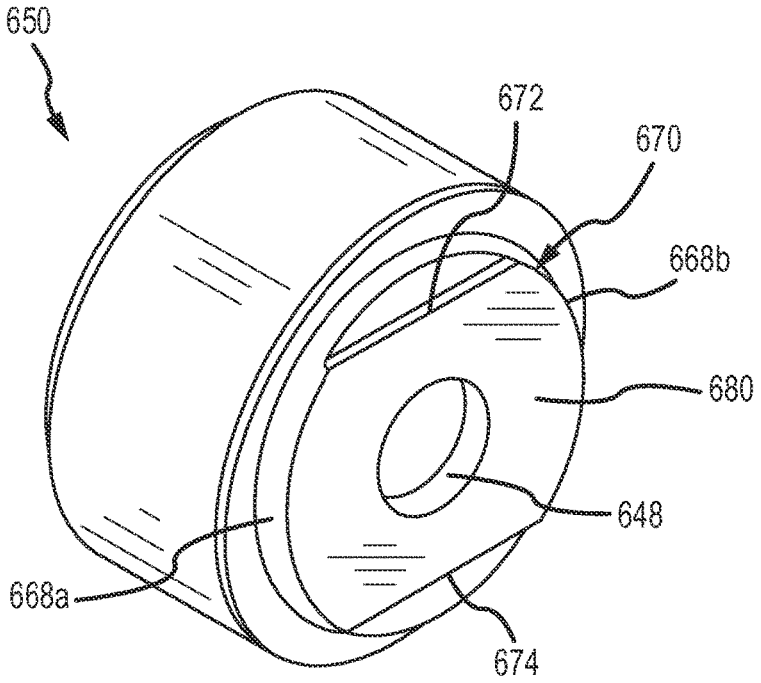
FIG. 6 shows a view of an exemplary shear bolt.

As seen in FIG. 6, the shear bolt 608 can include the internal bolt channel 648 across the shear region 670. By further example, spaces or voids of various shapes, sizes, and orientations can be provided to span across at least an axial portion of the shear region 670. Such spaces or voids can contribute to resilience against premature shearing under torsional loads and susceptibility to shearing under a predetermined axial load.

With continued reference to FIGS. 5A-5G and 6, and reference again to FIG. 1, exemplary operation of the whipstock assembly 600 with the shear bolt 608 is now provided. The whipstock assembly 600 may be similar to or the same as the whipstock assembly 130 of FIG. 1 and, therefore, may be able to be lowered into the wellbore 122 and secured therein to help facilitate the creation of the casing exit 132 in the casing 124. Accordingly, the whipstock assembly 600 may be lowered downhole within the wellbore 122 with the mills 204 secured to the whipstock 202, and upon reaching a location in the wellbore 122 where the casing exit 132 is to be formed, the whipstock assembly 600 may be latched into the anchor assembly 134, as generally described above.

As illustrated, the lead mill 206 may include one or more blades 234 (four shown) and a plurality of cutters 236 secured to each blade 234. In the above-described configuration, the lead mill 206 may pivot upon assuming a torsional load. Such torsional loads may be generated while latching in the whipstock assembly 200, as described above, or while lowering the whipstock assembly 600 downhole through portions of the wellbore 122 (FIG. 1) that require the whipstock assembly 600 to be rotated. Torsional loads applied to the whipstock assembly 600 may result in the lead mill 206 pivoting on one of the blades 234 that contacts the ramped surface 223 of the whipstock 202. A wider cross-sectional dimension of the shear region 670 (e.g., across the flanges 668*a,b*) can be aligned to sustain such torsional loads.

As the whipstock assembly 600 with shear bolt 608 is conveyed downhole and subsequently latched into the anchor assembly 134, the blade 234*a* of the lead mill 206 may be extended into the slot 308 of the bearing support 306. Once the whipstock assembly 600 is properly latched into the anchor assembly 134, weight is set down on the whipstock assembly 600 from a surface location, which provides an axial load to the lead mill 206 and transfers a predetermined axial load to the shear bolt 608. Upon assuming the predetermined axial load, the shear bolt 608 may shear or otherwise fail, and thereby free the mills 204 from engagement with the whipstock 202.

A narrower cross-sectional dimension of the shear region 670 (e.g., across grooves 672 and 674) can be angularly aligned to be subjected to the axial load. Accordingly, the shear region 670 of the shear bolt 608 allows more torque to be transmitted from the lead mill 206 to the whipstock 202 without shearing or otherwise compromising the structural integrity of the shear bolt 608, while also maintaining a susceptibility to shearing under predetermined axial loads.

Once free from the whipstock 202, the mills 204 may then be rotated about the central axis 232 and simultaneously advanced in the downhole direction (i.e., to the right in FIGS. 5A and 5B). As the mills 204 advance downhole, they ride up the ramped surface 223 of the whipstock 202 until engaging and milling the inner wall of the casing 124 to form the casing exit 132.

Figure 7A:
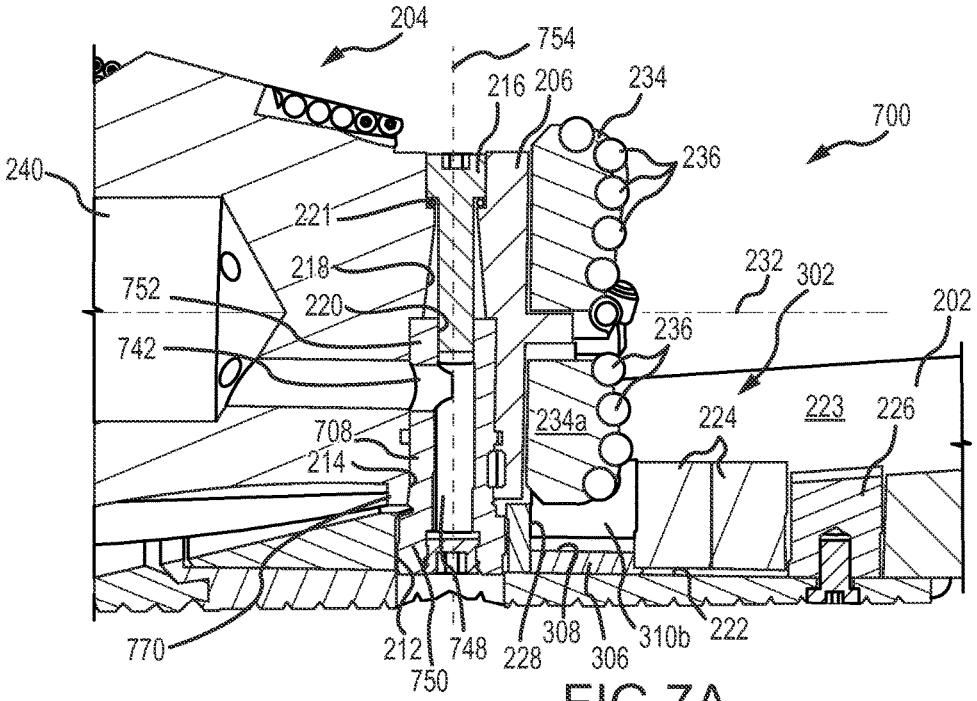
FIGS. 7A and 7B show views of an exemplary whipstock assembly
Figure 7B:
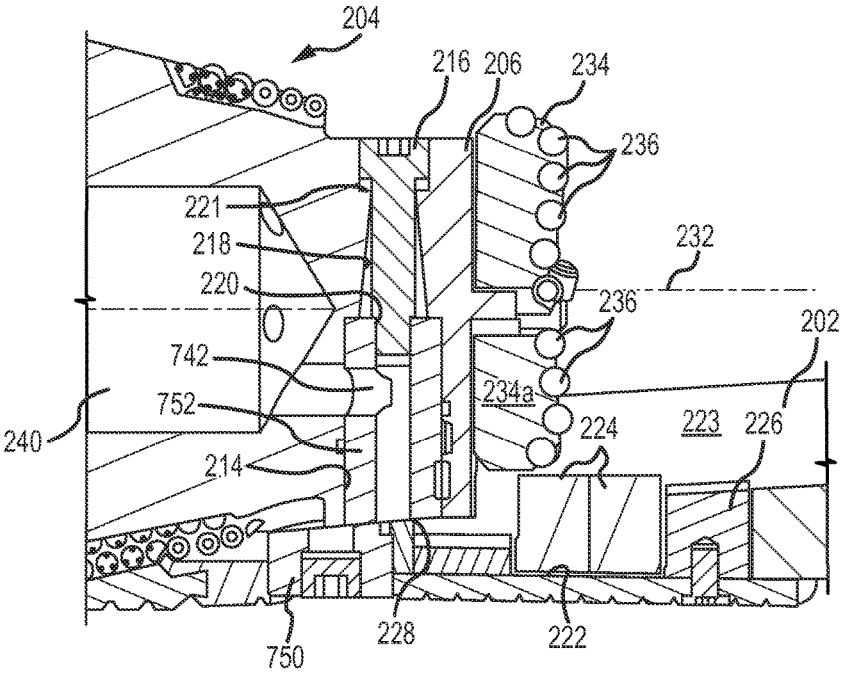

Referring now to FIGS. 7A and 7B, illustrated are various views of an exemplary whipstock assembly 700, according to one or more embodiments of the present disclosure. More particularly, FIG. 7A depicts a cross-sectional side view of the whipstock assembly 700 in a joined configuration, and FIG. 7B depicts a cross-sectional side view of the whipstock assembly 700 in a sheared configuration. The whipstock assembly 700 may be similar in some respects to the whipstock assembly 300 of FIG. 3A-3D and therefore may be best understood with reference thereto, where like numerals indicate like elements or components not described again in detail. Similar to the whipstock assembly 300 of FIG. 3A-3D, for example, the whipstock assembly 700 may include the whipstock 202 and the mills 204 (including the lead mill 206). The whipstock assembly 700 may further include a shear bolt 708 used to secure the lead mill 206 to the whipstock 202 and a retaining bolt 216 used to secure the shear bolt 708 to the lead mill 206. Moreover, the lead mill 206 may include the blades 234 (four shown) and the plurality of cutters 236 secured to each blade 234, as generally described above. As will be appreciated, more or fewer than four blades 234 may be provided on the lead mill 206, without departing from the scope of the disclosure.

As best seen in FIGS. 7A and 7B, the shear bolt 708 may have an internal bolt channel 748 into which the retaining bolt 216 can engage the shear bolt 708 at the location of the threaded cavity 720. The internal bolt channel 748 of the shear bolt 708 can be provided in fluid communication with an internal mill channel 240 via a side port 742 of the shear bolt 708. The orientation of the shear bolt 708 that places the side port 742 of the shear bolt 708 in alignment with an opening to the internal mill channel 240 can correspond to a preferred orientation of the shear region with respect to the whipstock 202.

As shown in FIGS. 7A and 7B, the shear bolt 708 can be oriented such that a central axis 754 (FIG. 7A) of the shear bolt 708 is orthogonal to a central axis 232 of the mills 204 (including the lead mill 206). The retaining bolt 216 may be similarly oriented, such that a central axis of the retaining bolt 216 coincides with the central axis 754 of the shear bolt 708.

Figure 7C:
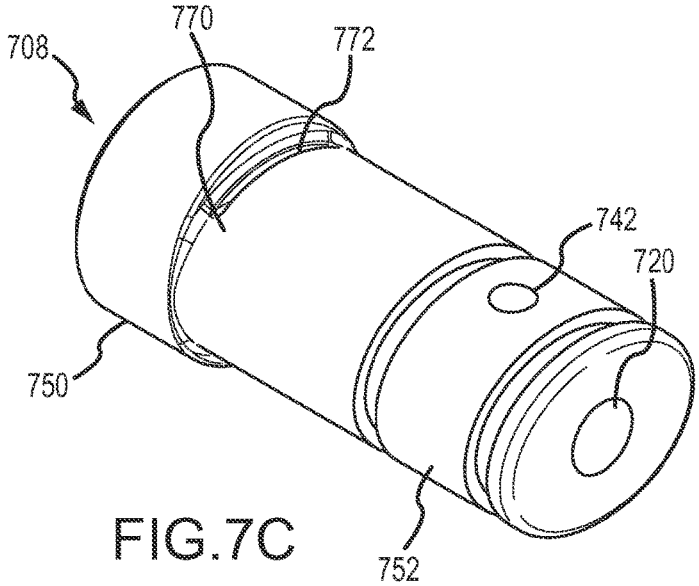
FIGS. 7C-7E show views of an exemplary shear bolt.
Figure 7D:
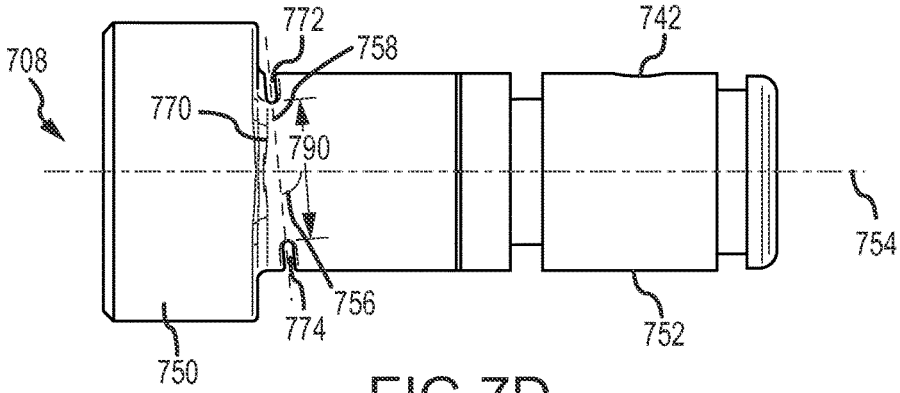
Figure 7E:
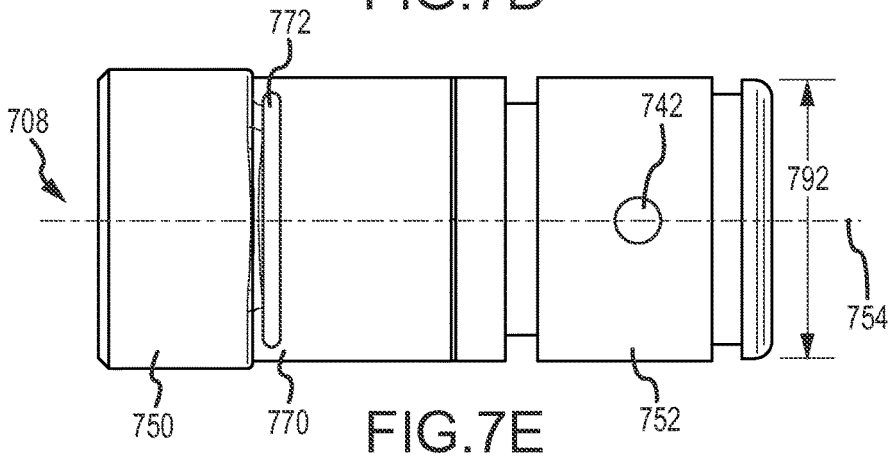

Referring now to FIGS. 7C-7E, with continued reference to FIGS. 7A-7B, illustrated are various views of an exemplary shear bolt 708, according to one or more embodiments of the present disclosure. More particularly, FIG. 7C depicts an isometric view of the shear bolt 708, and FIGS. 7D and 7E depict side views of the shear bolt 708. The shear bolt 708 may be, in some respects, similar to the shear bolt 508 of FIGS. 4C-4E. For example, the shear bolt 708 may include a head 750 and a main body 752, separated by a shear region 770. Moreover, the shear bolt 708 may include a threaded cavity 720 and a side port 742.

As best seen in FIG. 7D, the shear region 770 may be formed as one or more grooves. For example, the shear region 770 can include a first groove 772 and a second groove 774. Each of the grooves 772, 774 can be formed by a radially inward intrusion from a radially outer periphery of the head 750 and/or the main body 752. Each of the grooves 772, 774 of the shear region 770 may extend only partially circumferentially about the central axis 754, such that the grooves 772, 774 do not connect with one another. The first and second grooves 772 and 774 can be positioned on radially opposite sides of the central axis 754 such that they are spaced or offset about the central axis 754 (i.e. circumferentially spaced) from each other by 180°. A trough of the groove 772 and/or the groove 774 can be flat, concave, convex, and/or undulating.

The shear bolt 708 may further include one or more portions having a noncircular cross-sectional dimension. For example, the main body 752 and/or the shear region 770 can have a lesser width 790 in one dimension and a greater width 792 in another dimension, thereby providing a main body 752 that generally exhibits an oval or ovoid cross-section. The lesser width 790 can be the shortest distance across the shear region 770 and/or the main body 752. The lesser width 790 can be generally aligned with the axial force intended to shear the shear bolt 708, thereby defining an axial shear limit. The greater width 792 can be the longest distance across the shear region 770 and/or the main body 752. The greater width 792 can be generally aligned to sustain a torsional load applied to the whipstock assembly 700, thereby defining a rotary shear limit, greater than the axial shear limit.

The cross-section along the plane 758 and/or a cross-section through the main body 752 can define a non-circular shape. For example, such a cross-sectional shape can be oval, as shown in FIGS. 7C-7E. The lead mill 206 can be formed to accommodate the shear bolt 708, including the non-circular cross-sectional shape. For example, the shear bolt 708 can be received into the lead mill 206 in a particular angular orientation that corresponds to a desired angular orientation of the shear region 770.

The shear region 770 may lie in, contain, or otherwise be defined by the plane 758 extending entirely through the shear bolt 708. The plane 758 may form an angle 756 with respect to the central axis 754 of the shear bolt 708. The angle 756 may be the smallest one of several angles formed by a given intersection of the plane 758 and the central axis 754. The angle 756 may be perpendicular, or the angle 756 may be acute, such that the plane 758 is oblique with respect to the central axis 754. For example, the angle 756 may be greater than 60°, less than 90°, and/or equal to 90°.

As best seen in FIG. 7D, the first and second grooves 772 and 774 can be positioned on radially opposite sides of the central axis 754. The axial locations of the first and second grooves 772 and 774 can be different, to define a plane 758 that is oblique with respect to the central axis 754. Accordingly, the first groove 772 can be axially closer to an end of the shear bolts 708 formed by the head 750, and the second groove 774 can be axially closer to an end of the shear bolt 708 formed by the main body 752.

As best seen in FIG. 7B, the angle 756 may correspond to an angle of the ramped surface 223 of the whipstock 202 with respect to a central axis 232 of the mills 204. For example, the angle 756 may be complementary with respect to an angle of the ramped surface 223. Such a configuration provides a shear region 770 that forms an angle similar to that of the ramped surface 223, to provide a smooth transition.

With continued reference to FIGS. 7A-7E, and reference again to FIG. 1, exemplary operation of the whipstock assembly 700 with shear bolt 708 is now provided. The whipstock assembly 700 may be similar to or the same as the whipstock assembly 130 of FIG. 1 and, therefore, may be able to be lowered into the wellbore 122 and secured therein to help facilitate the creation of the casing exit 132 in the casing 124. Accordingly, the whipstock assembly 700 may be lowered downhole within the wellbore 122 with the mills 204 secured to the whipstock 202, and upon reaching a location in the wellbore 122 where the casing exit 132 is to be formed, the whipstock assembly 700 may be latched into the anchor assembly 134, as generally described above.

As illustrated, the lead mill 206 may include one or more blades 234 (four shown) and a plurality of cutters 236 secured to each blade 234. In the above-described configuration, the lead mill 206 may pivot upon assuming a torsional load. Such torsional loads may be generated while latching in the whipstock assembly 200, as described above, or while lowering the whipstock assembly 700 downhole through portions of the wellbore 122 (FIG. 1) that require the whipstock assembly 700 to be rotated. Torsional loads applied to the whipstock assembly 700 may result in the lead mill 206 pivoting on one of the blades 234 that contacts the ramped surface 223 of the whipstock 202. A wider cross-sectional dimension of the shear region 770 (e.g., across the flanges 768*a,b*) can be aligned to sustain such torsional loads.

As the whipstock assembly 700 with shear bolt 708 is conveyed downhole and subsequently latched into the anchor assembly 134, the blade 234*a* of the lead mill 206 may be extended into the slot 308 of the bearing support 306. Once the whipstock assembly 700 is properly latched into the anchor assembly 134, weight is set down on the whipstock assembly 700 from a surface location, which provides an axial load to the lead mill 206 and transfers a predetermined axial load to the shear bolt 708. Upon assuming the predetermined axial load, the shear bolt 708 may shear or otherwise fail, and thereby free the mills 204 from engagement with the whipstock 202.

A narrower cross-sectional dimension of the shear region 770 (e.g., across grooves 772 and 774) can be aligned to be subjected to the axial load. Accordingly, the shear region 770 of the shear bolt 708 allows more torque to be transmitted from the lead mill 206 to the whipstock 202 without shearing or otherwise compromising the structural integrity of the shear bolt 708, while also maintaining a susceptibility to shearing under predetermined axial loads.

Once free from the whipstock 202, the mills 204 may then be rotated about the central axis 232 and simultaneously advanced in the downhole direction (i.e., to the right in FIGS. 7A and 7B). As the mills 204 advance downhole, they ride up the ramped surface 223 of the whipstock 202 until engaging and milling the inner wall of the casing 124 to form the casing exit 132.

Embodiments disclosed herein include:

A. A shear bolt for coupling a lead mill to a whipstock, including a head; and a main body extending from the head along a central axis and having a shear region; wherein the shear region lies in a plane that is oblique with respect to the central axis; wherein a cross-section of the shear region in the plane has (1) a first width in a first dimension orthogonal to the central axis and (2) a second width, less than the first width, in a second dimension transverse to the central axis.

B. A whipstock assembly, including a lead mill providing one or more blades and extending about a mill axis; a whipstock providing a ramped surface at a nonzero angle with respect to the mill axis; and a shear bolt coupling the lead mill to the whipstock and including: a head; a main body extending from the head along a bolt axis and having a shear region; wherein the shear region lies in a plane at the nonzero angle with respect to the mill axis; wherein a cross-section of the shear region in the plane has (1) a first width in a first dimension, orthogonal to the mill axis and the bolt axis, and (2) a second width, less than the first width, in a second dimension transverse to the bolt axis.

C. A method including extending a whipstock assembly into a wellbore, the whipstock assembly including a lead mill providing one or more blades and extending along a mill axis, a whipstock providing a ramped surface at a nonzero angle with respect to the mill axis, and a shear bolt coupling the lead mill to the whipstock; and shearing the shear bolt along a shear region by applying an axial force to the whipstock assembly with the lead mill across a radially smallest cross-sectional width of the shear region, wherein the shear region lies in a plane at the nonzero angle with respect to the mill axis.

D. A shear fastener for coupling a mill to a downhole tool, including: a head; and a main body extending from the head along a central axis and having a shear region, transverse to the central axis, defined by one or more grooves extending radially inwardly from an outer surface of the main body, such that a radial depth of the shear region varies circumferentially along the main body.

Each of embodiments A, B, C, and D may have one or more of the following additional elements in any combination: Element 1: the plane of the shear region is aligned with a surface of the whipstock. Element 2: the shear region has (1) a first shear limit for withstanding a torque between the lead mill and the whipstock and (2) a second shear limit, lower than the first shear limit, for withstanding a force parallel to the mill axis and between the lead mill and the whipstock. Element 3: a first portion of the shear region on a first radial side of the bolt axis is axially offset with respect to a second portion of the shear region on a second radial side of the bolt axis, and wherein the second radial side is opposite the first radial side. Element 4: the shear region is defined by a groove extending radially inward from an outer surface of the main body. Element 5: the groove is continuous about the bolt axis. Element 6: the second dimension is oblique with respect to the bolt axis. Element 7: the main body defines (1) a first groove extending partially circumferentially about the main body on a first radial side of the bolt axis and (2) a second groove extending partially circumferentially about the main body on a second radial side of the bolt axis, opposite the first radial side. Element 8: the shearing exposes a shear surface of the shear bolt that is approximately flush with the ramped surface. Element 9: the extending includes applying a torque between the lead mill and the whipstock, the torque not exceeding a rotatory shear limit of the shear region. Element 10: the shearing includes applying a force parallel to the mill axis and between the lead mill and the whipstock that exceeds an axial shear limit of the shear region. Element 11: the axial shear limit is lower than the rotary shear limit. Element 12: the radially smallest cross-sectional width of the shear region is a width in a dimension transverse to an axis of the shear bolt. Element 13: a main body extending from the head along a central axis and having a shear region, transverse to the central axis, defined by one or more grooves extending radially inwardly from an outer surface of the main body, such that a radial depth of the shear region varies circumferentially along the main body. Element 14: a single continuous groove extending at a varying radial depth along the central axis. Element 15: a plurality of circumferentially spaced grooves, such that the radial depth of the shear region is greater at locations of the grooves than at locations circumferentially between the circumferentially spaced grooves. Element 16: a threaded portion defining a major diameter and a minor diameter, wherein the one or more grooves extended radially inwardly of the minor diameter.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A shear fastener for coupling a mill to a downhole tool, comprising:

a head; and a main body extending from the head along a central axis and having a shear region, transverse to the central axis, defined by one or more grooves extending radially inwardly from an outer surface of the main body, such that a radial depth of the shear region varies circumferentially about the shear region, wherein the shear region defines a preferential shear plane, wherein the main body has a first width within the preferential shear plane that is greater than a second width of the main body within the preferential shear plane, the first width is measured in a first direction orthogonal relative to the central axis of the main body, and the second width is measured in a second direction transverse relative to the central axis of the main body, and wherein the first width in the first direction is orthogonal to a central axis of the mill, and the central axis of the main body is orthogonal to the central axis of the mill when the mill is coupled to the downhole tool via the shear fastener.

2. The shear fastener of claim 1, wherein the one or more grooves comprises a single continuous groove extending about an entire circumference of the main body.

3. The shear fastener of claim 1, wherein the one or more grooves comprises a plurality of circumferentially spaced grooves, such that the radial depth of the shear region is greater at locations of the grooves than at locations circumferentially between the circumferentially spaced grooves.

4. The shear fastener of claim 3, wherein the main body further comprises:

a first groove extending partially circumferentially about the main body on a first radial side of the central axis; and a second groove extending partially circumferentially about the main body on a second radial side of the central axis, opposite the first radial side.

5. The shear fastener of claim 1, wherein the main body comprises a threaded portion defining a major diameter and a minor diameter, wherein the one or more grooves extended radially inwardly of the minor diameter.

6. The shear fastener of claim 1, wherein a first portion of the shear region on a first radial side of the central axis is axially offset with respect to a second portion of the shear region on a second radial side of the central axis opposite the first radial side.

7. A downhole tool assembly, comprising:

a mill providing one or more blades and exhibiting a mill axis;

a downhole tool providing a ramped surface at a nonzero angle with respect to the mill axis; and a shear fastener coupling the mill to the downhole tool and comprising:

a head; and a main body extending from the head along a central axis and having a shear region, transverse to the central axis, defined by one or more grooves extending radially inwardly from an outer surface of the main body, such that a radial depth of the shear region defines a preferential shear plane, and wherein the main body has a first width within the preferential shear plane that is greater than a second width of the main body within the preferential shear plane, wherein the first width is measured in a first direction orthogonal relative to the central axis, and the second width is measured in a second direction transverse relative to the central axis, and wherein the first width in the first direction is orthogonal relative to the mill axis, and the central axis is orthogonal to the mill axis when the mill is coupled to the downhole tool via the shear fastener.

8. The downhole tool assembly of claim 7, wherein the one or more grooves comprises a plurality of circumferentially spaced grooves, such that the radial depth of the shear region is greater at locations of the grooves than at locations circumferentially between the circumferentially spaced grooves.

9. The downhole tool assembly of claim 7, wherein the shear region has (1) a first shear limit for withstanding a torque between the mill and the downhole tool and (2) a second shear limit, lower than the first shear limit, for withstanding a force parallel to the mill axis and between the mill and the downhole tool.

10. The downhole tool assembly of claim 7, wherein the downhole tool is a whipstock and wherein the preferential shear plane of the shear region is parallel to a ramped surface of the downhole tool.

11. The downhole tool of claim 7, wherein a first portion of the shear region on a first radial side of the central axis is axially offset with respect to a second portion of the shear region on a second radial side of the central axis, and wherein the second radial side is opposite the first radial side.

12. The downhole tool of claim 7, wherein the main body further comprises:

a first groove extending partially circumferentially about the main body on a first radial side of the central axis; and a second groove extending partially circumferentially about the main body on a second radial side of the central axis, opposite the first radial side.

13. The downhole tool of claim 7, wherein the main body comprises a threaded portion defining a major diameter and a minor diameter, wherein the one or more grooves extended radially inwardly of the minor diameter.

14. A method, comprising:

extending a downhole tool assembly into a wellbore, the downhole tool assembly including a mill providing one or more blades and extending along a mill axis, a downhole tool providing a ramped surface at a nonzero angle with respect to the mill axis, and a shear fastener coupling the mill to the downhole tool, a shear region of the shear fastener having a first shear limit for withstanding a torque between the mill and the downhole tool during the extending, the shear region defining a preferential shear plane, wherein a body of the shear fastener has a first width within the preferential shear plane that is greater than a second width thereof within the preferential shear plane, wherein the first width is measured in a first direction orthogonal relative to a central axis of the shear fastener, the second width is measured in a second direction transverse relative to the central axis of the shear fastener, and wherein the first width in the first direction is orthogonal relative to the mill axis, and the central axis of the shear fastener is orthogonal to the mill axis when the mill is coupled to the downhole tool via the shear fastener; and shearing the shear fastener along the shear region, transverse to the central axis of the shear fastener, defined by one or more grooves extending radially inwardly from an outer surface of the body of the shear fastener, such that a radial depth of the shear region varies circumferentially about the shear region, wherein the shearing comprises exceeding a second shear limit of the shear region, lower than the first shear limit, for withstanding a force parallel to the mill axis and between the mill and the downhole tool.

15. The method of claim 14, wherein the shearing comprises applying an axial force to the downhole tool assembly with the mill across a radially smallest width of the shear region, wherein the shear region lies in the preferential shear plane of the shear region at the nonzero angle with respect to the mill axis.

16. The method of claim 14, wherein the extending comprises applying a torque between the mill and the downhole tool, the torque not exceeding the first shear limit of the shear region.

* * * * *